US011739765B1

(12) United States Patent
De Jesus Aguilar

(10) Patent No.: US 11,739,765 B1
(45) Date of Patent: Aug. 29, 2023

(54) FLOW BOOSTER CELL

(71) Applicant: Narciso De Jesus Aguilar, Katy, TX (US)

(72) Inventor: Narciso De Jesus Aguilar, Katy, TX (US)

( * ) Notice: Subject to any disclaimer, the term of this patent is extended or adjusted under 35 U.S.C. 154(b) by 13 days.

(21) Appl. No.: 17/652,479

(22) Filed: Feb. 24, 2022

(51) Int. Cl.

| | |
|---|---|
| ***F04D 29/22*** | (2006.01) |
| ***F04D 13/04*** | (2006.01) |
| ***F04D 25/04*** | (2006.01) |
| ***E21B 43/12*** | (2006.01) |
| ***F04B 47/04*** | (2006.01) |
| ***F04D 17/12*** | (2006.01) |
| ***F04D 29/42*** | (2006.01) |
| ***F04D 29/44*** | (2006.01) |
| ***F04D 1/06*** | (2006.01) |

(52) U.S. Cl.
CPC ..... *F04D 29/426* (2013.01); *E21B 43/129* (2013.01); *F04B 47/04* (2013.01); *F04D 1/06* (2013.01); *F04D 13/043* (2013.01); *F04D 25/045* (2013.01); *F04D 29/22* (2013.01); *F04D 29/448* (2013.01)

(58) Field of Classification Search
CPC ..... F04D 1/06; F04D 13/043; F04D 17/12; F04D 17/122; F04D 25/045; F04D 29/22; F04D 29/426; F04D 29/448; E21B 43/013; E21B 43/101; E21B 43/124; E21B 43/129; F04B 47/04
USPC ..... 417/171, 197, 409
See application file for complete search history.

(56) References Cited

U.S. PATENT DOCUMENTS

| | | | | |
|---|---|---|---|---|
| 4,215,976 A * | 8/1980 | Neumann | F24T 10/10 | 415/95 |
| 7,207,381 B2 * | 4/2007 | Sharp | E21B 43/129 | 166/54.1 |
| 9,243,481 B1 * | 1/2016 | Pierce | F04D 13/10 | |
| 2015/0098793 A1 * | 4/2015 | Baski | F04D 13/08 | 415/111 |

* cited by examiner

*Primary Examiner* — Justin D Seabe

(57) ABSTRACT

The object of this invention is to create the elements necessary to supply lifting energy in flowlines or recipients containing motionless fluids. The invention provides a motive force through hollow shafts or hollow stators inside a streamlined housing having a rotor comprised of two concentric and coplanar arrays of external and internal blades working together as pump and turbine on the same plane. To operate, the artifact requires a source of fluid supply acting as motive fluid to boost a static or relative slow-motion fluid. The motive fluid travels from an internal hollow shaft toward an external hollow shaft, or from a scroll case throughout hollow stators to an internal array of blades to induce movement on the rotor. The present invention is designed to be used in different locations for different applications in different positions, to support the transportation of fluids. It operates with any fluid supply such as gas or liquid or a mix of both. The artifact does not require direct sources of electrical power.

10 Claims, 20 Drawing Sheets

Cross Section Plane A-A of the Artifact showing Movement Direction of the Motive and Drawn Fluids

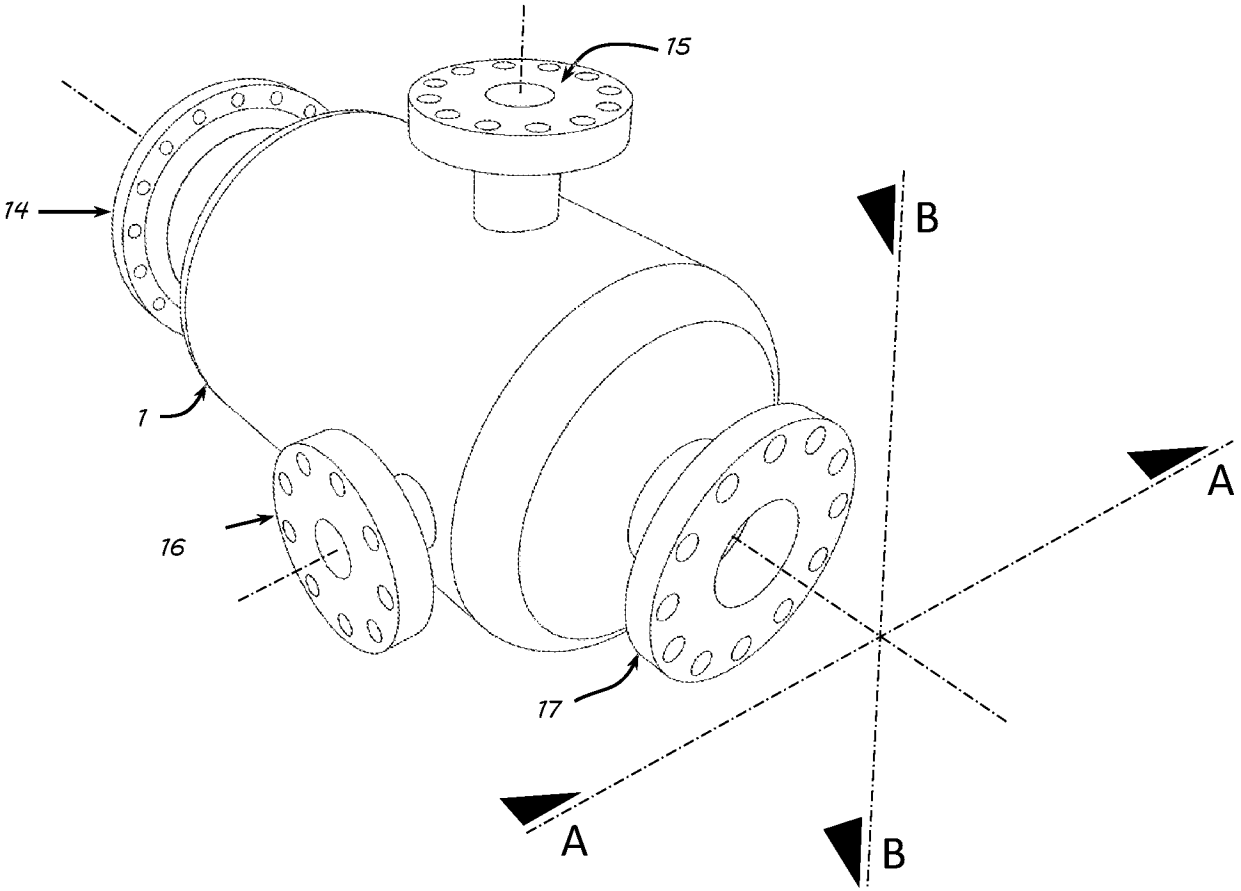
FIG. 1: External Perspective View of the Artifact showing Motionless and Motive Fluids Nozzles

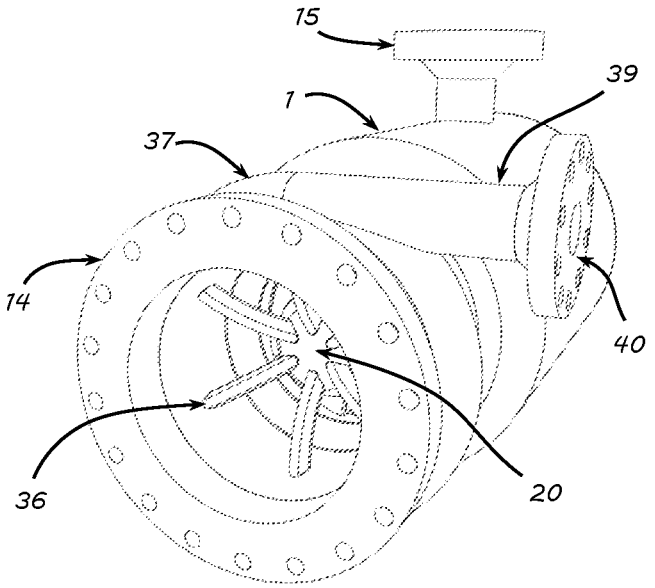
FIG. 2: External Perspective View of the Artifact showing Version with Virtual Stators and Scroll Case
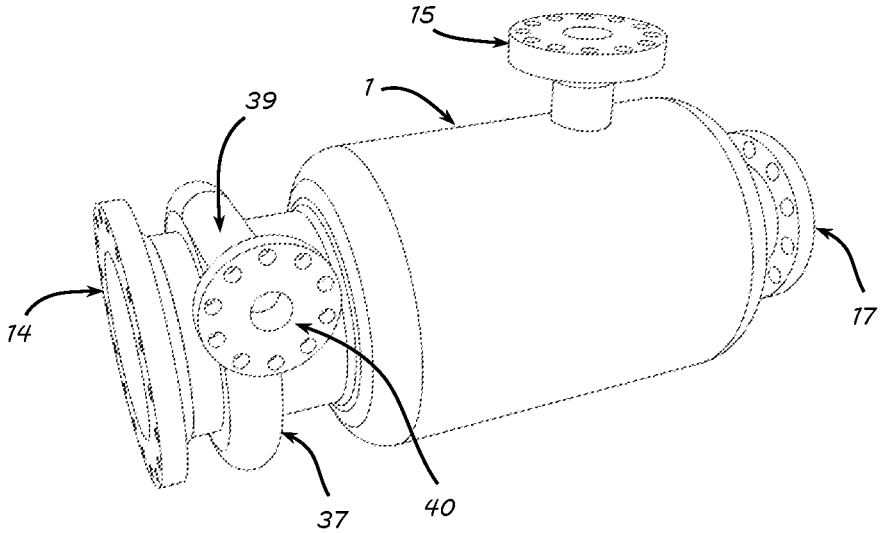
FIG. 3: External Perspective View of the Artifact showing Version with Virtual Stators, Scroll Case and Motive Fluid Outlet

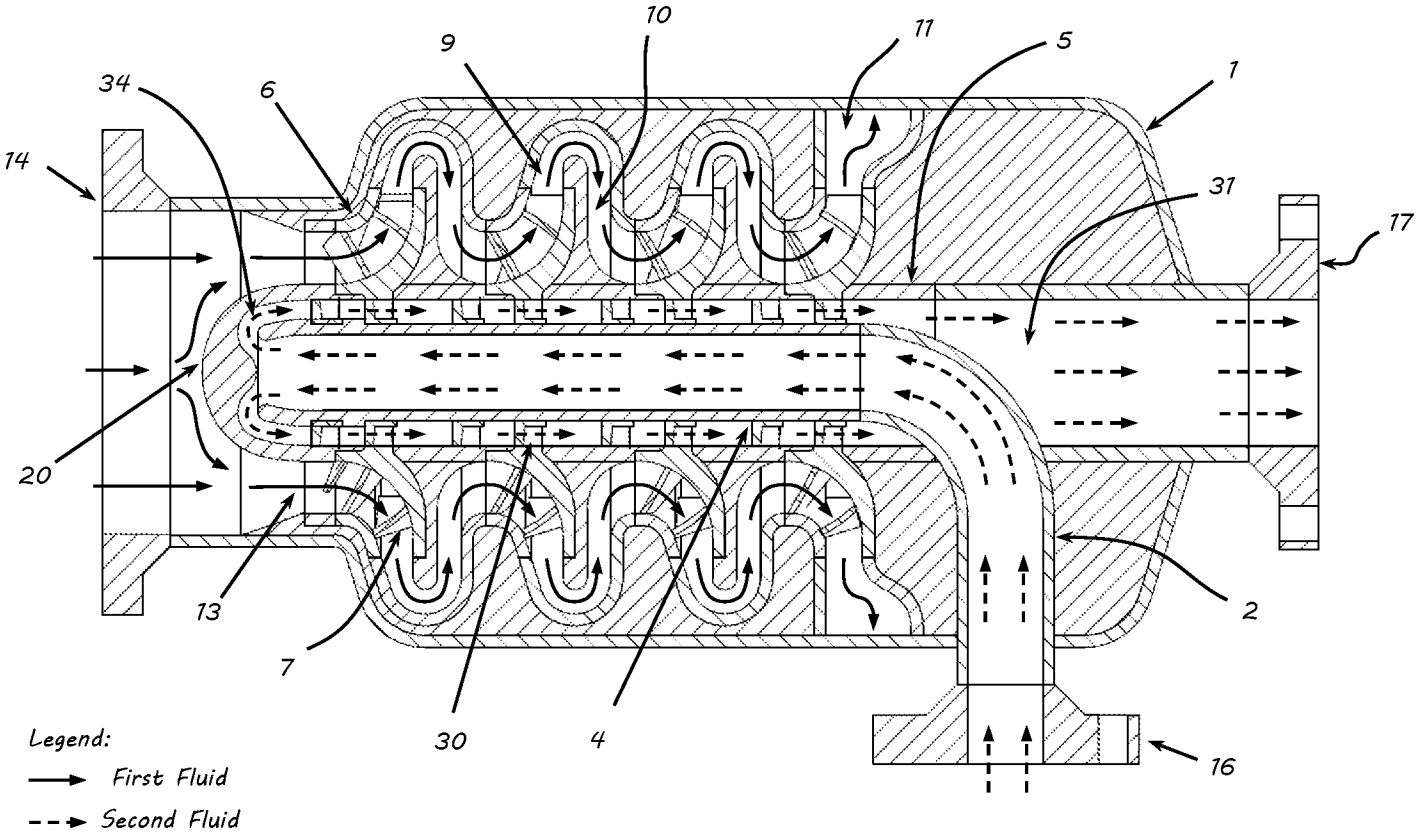
FIG. 4: Cross Section Plane A-A of the Artifact showing Movement Direction of the Motive and Drawn Fluids

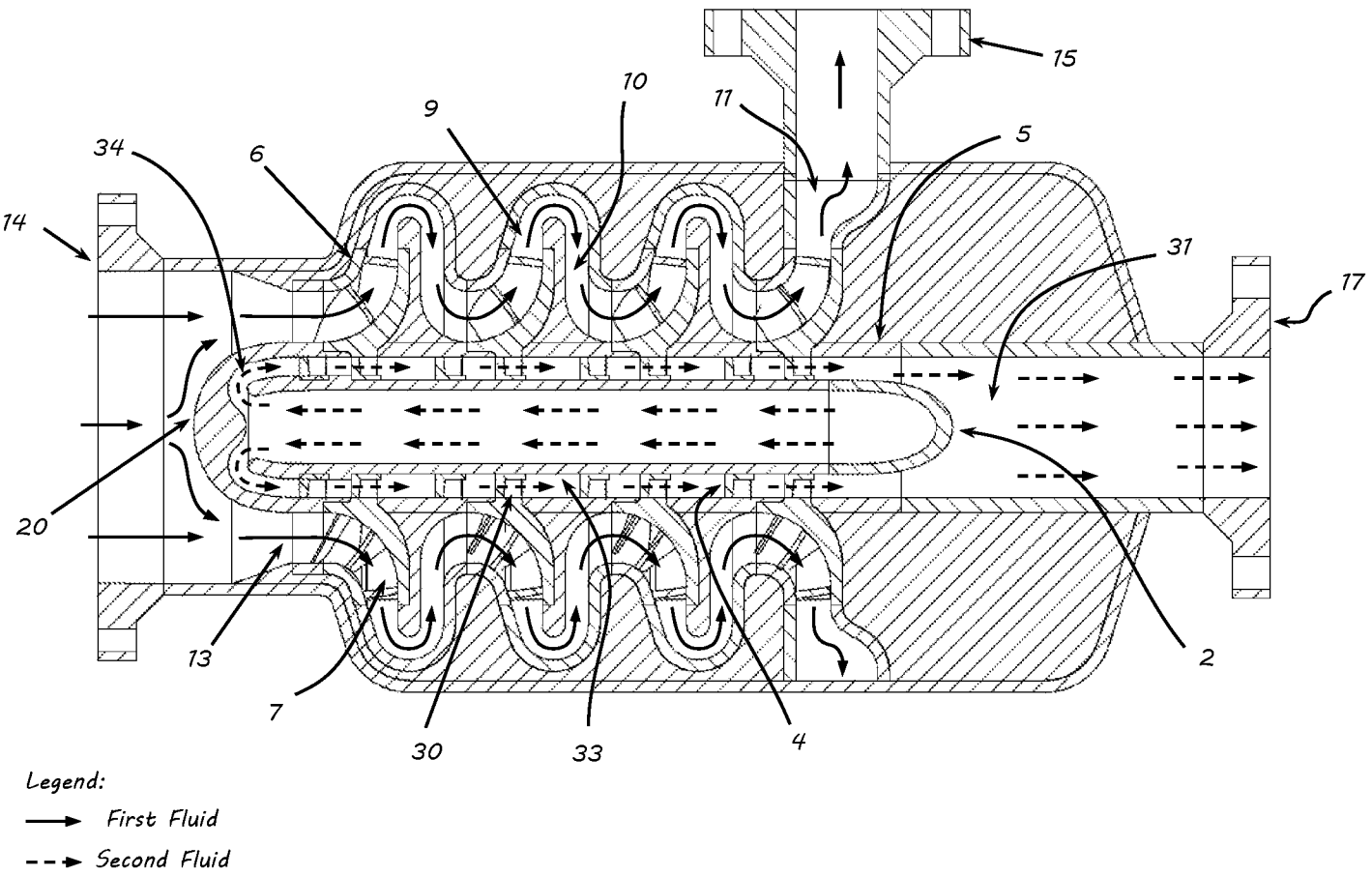
FIG. 5: Cross Section Plane B-B of the Artifact showing External Discharge of Motionless Fluid

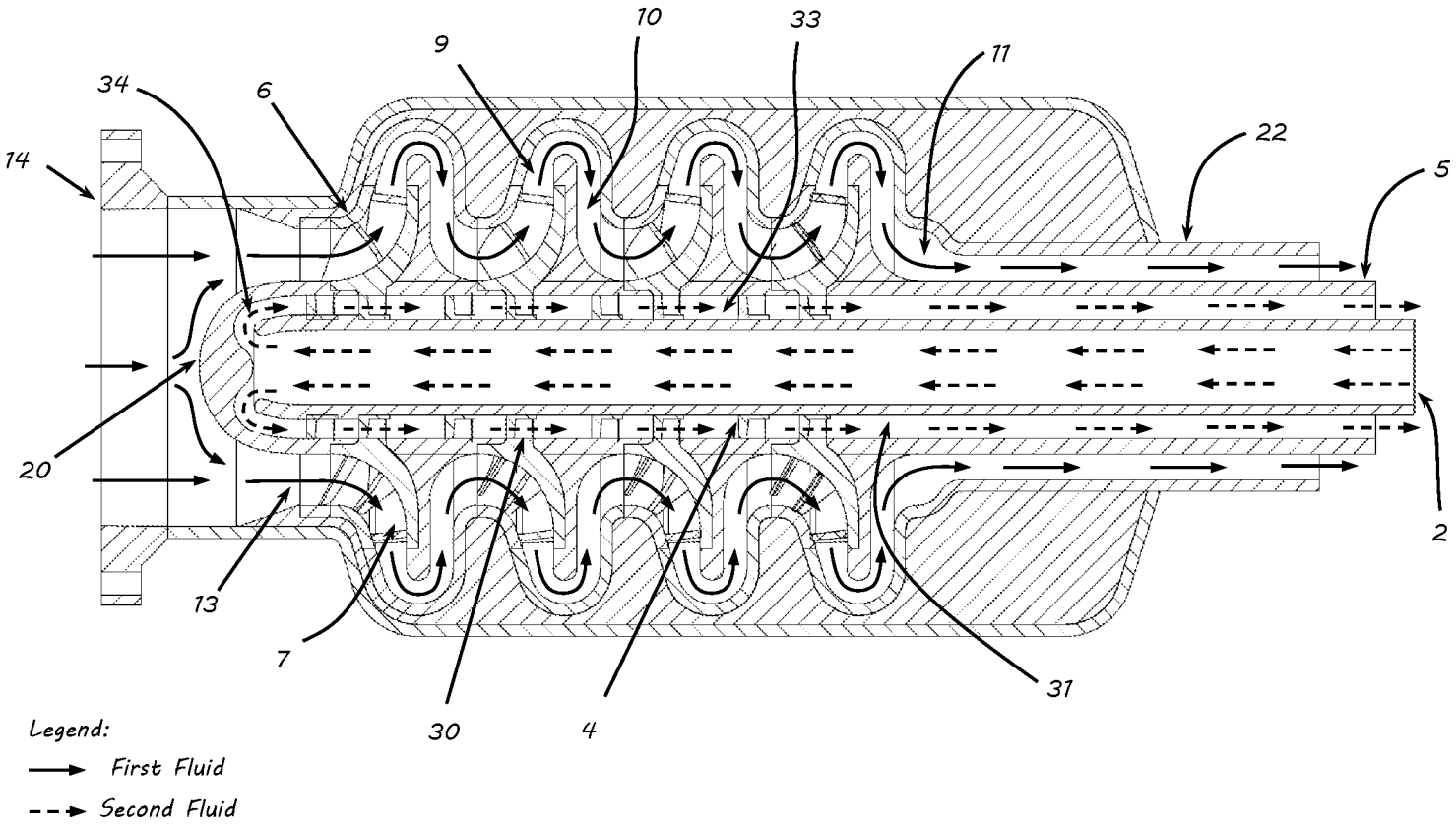
FIG. 6: Cross Section Plane A-A of the Artifact showing Introduction and Discharge of Fluids in Concentric Conductors

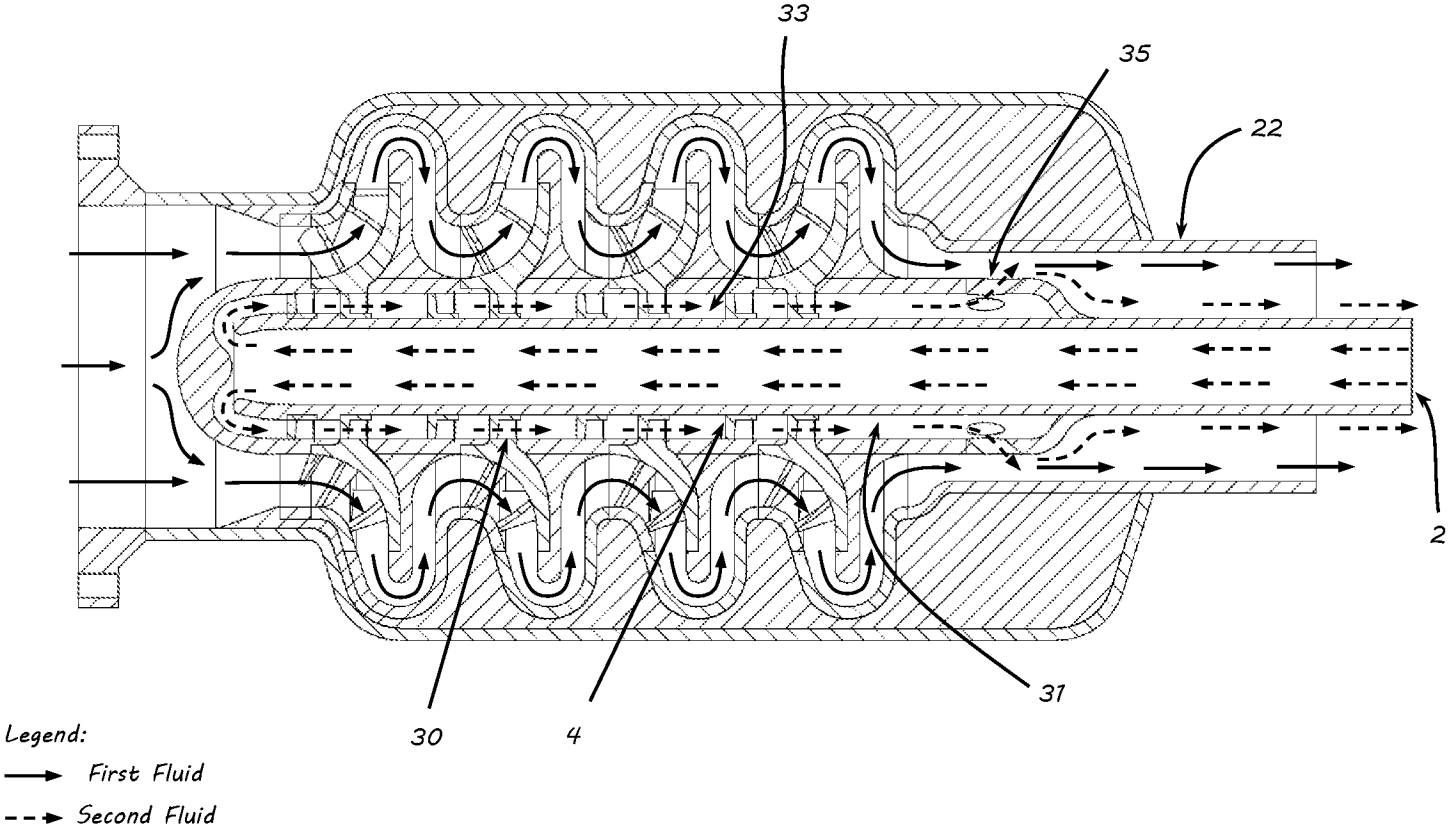
FIG. 7: Cross Section Plane B-B of the Artifact showing Internal Motive Fluid Discharge

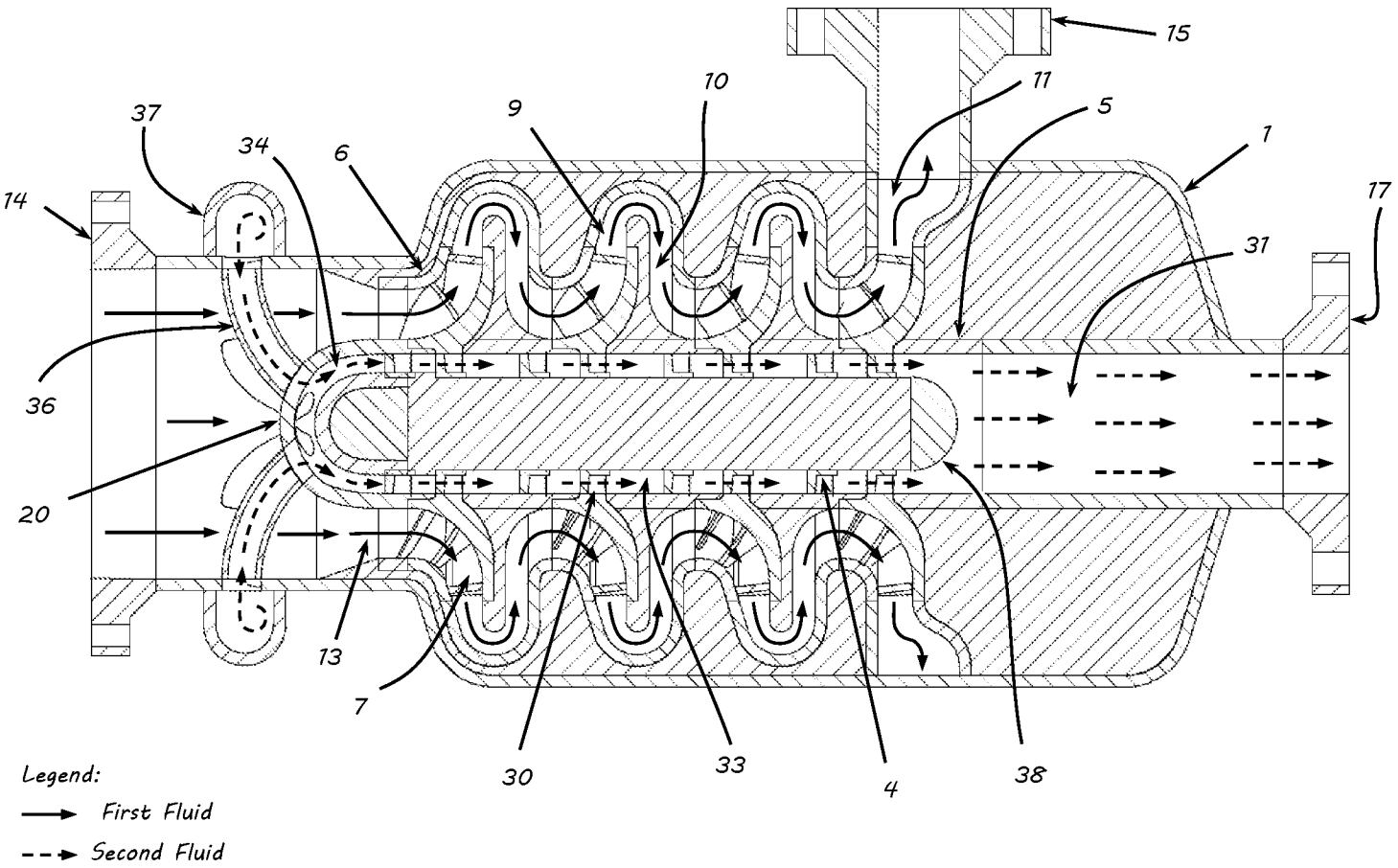
FIG. 8: Cross Section Plane B-B of the Artifact showing Movement Direction of the Motive and Drawn Fluids

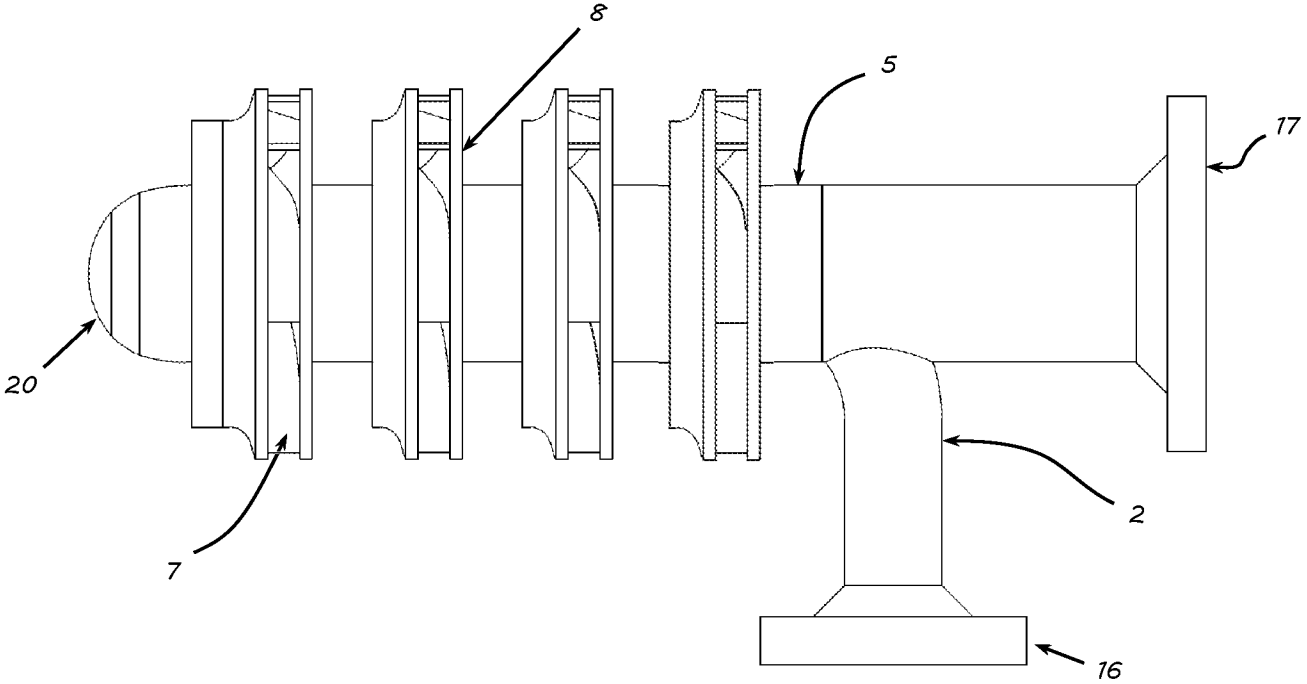
FIG. 9: Top View of the First and Second Hollow Shafts, and four Rotors

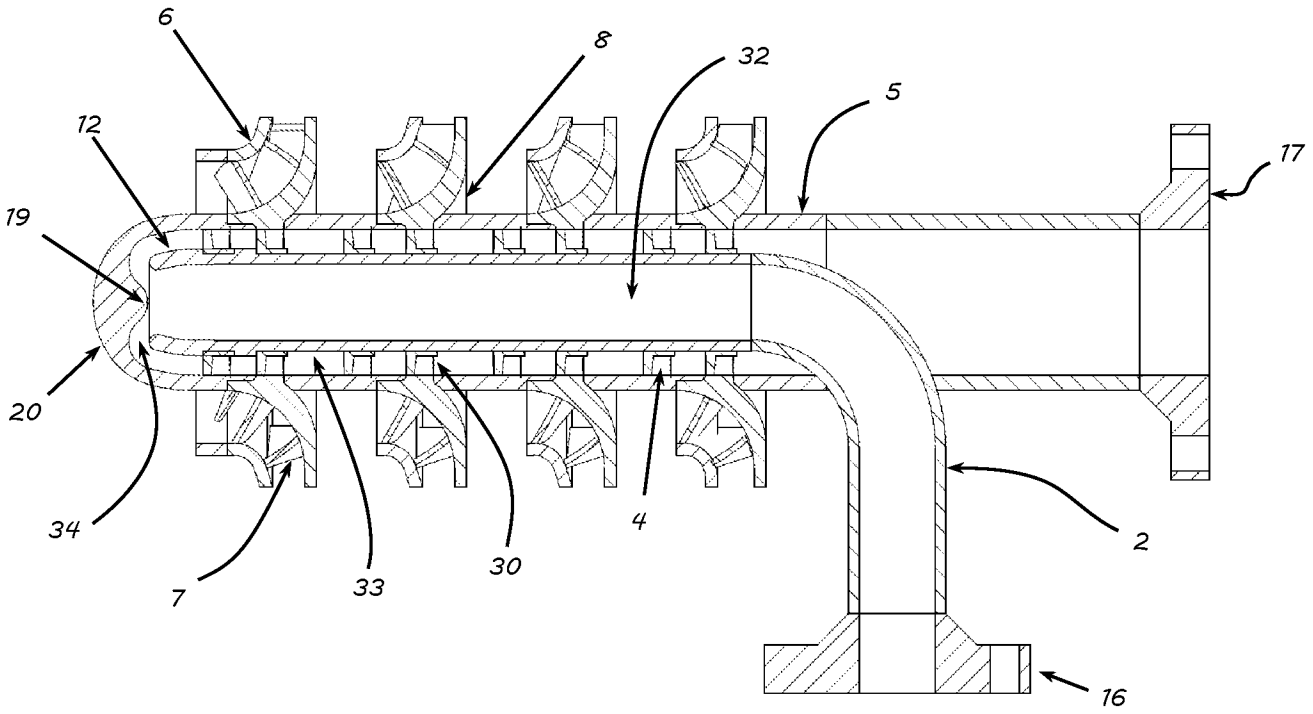
FIG. 10: Cross Section Plane A-A of the First and Second Hollow Shafts, and four Rotors

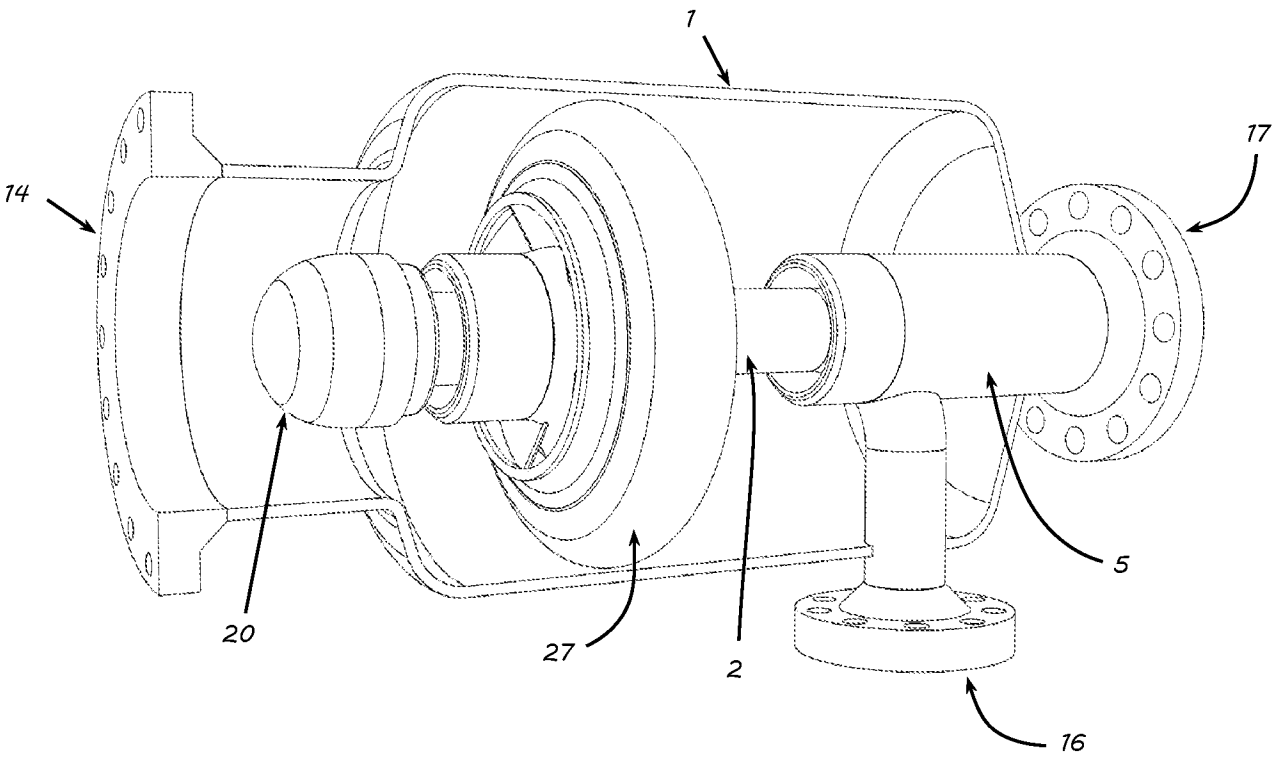
FIG. 11: Perspective Section View of the Artifact showing One Cell Assembly

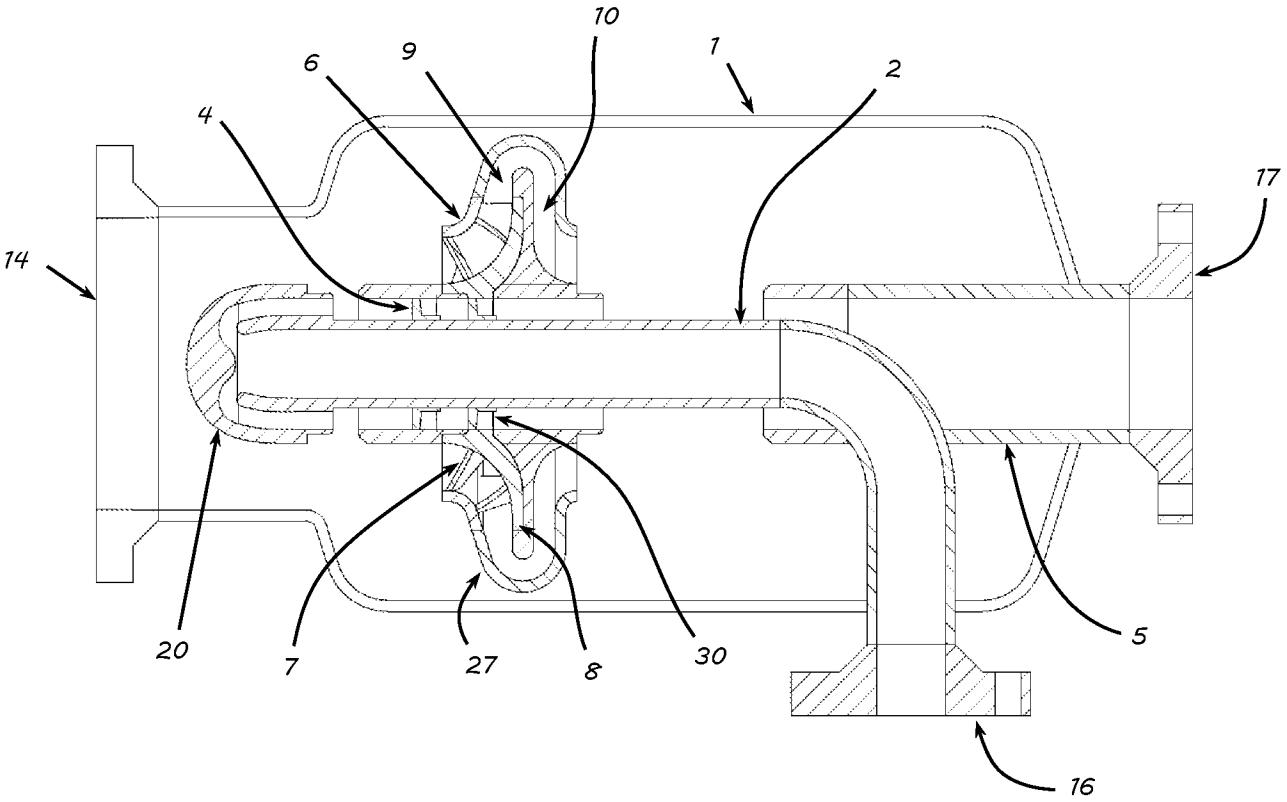
FIG. 12: Cross Section Plane A-A View of the Artifact showing One Flow Booster Cell

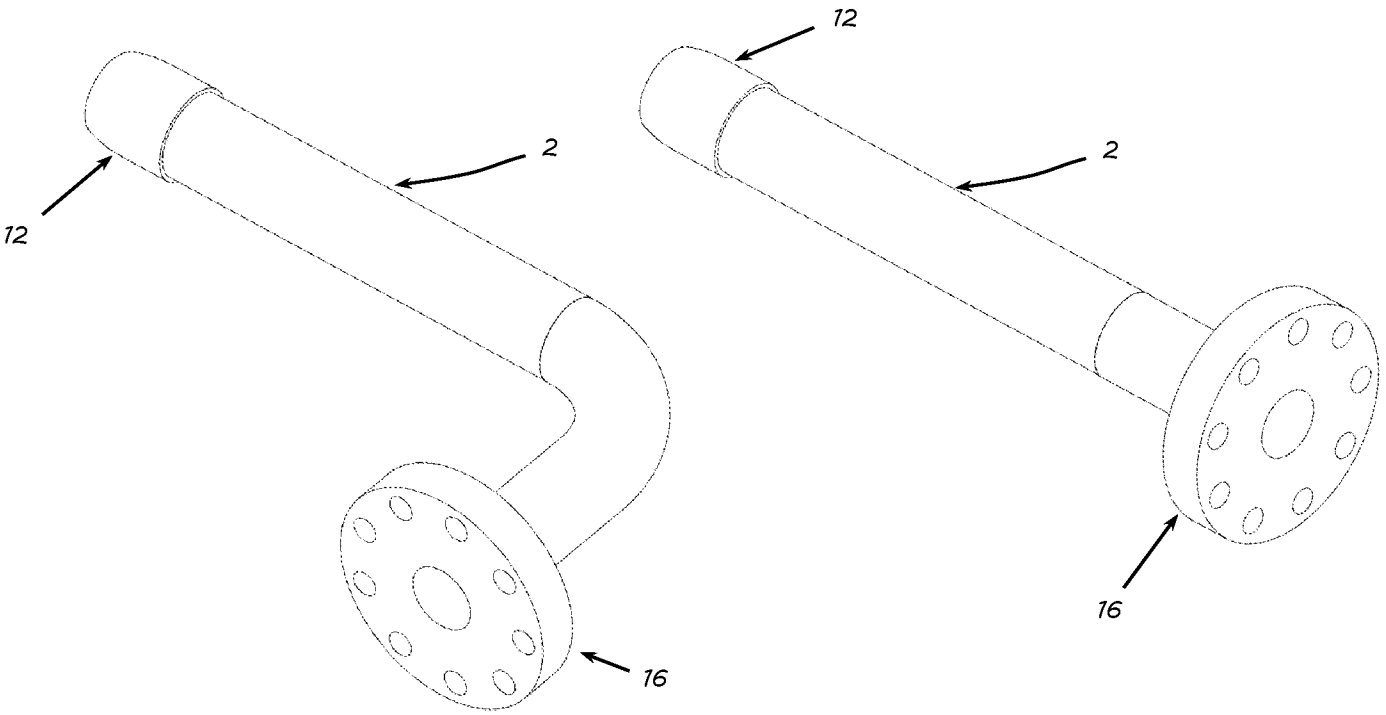
FIG. 14: Perspective View of the First Hollow Shaft (Straight Inlet Configuration)
FIG. 13: Perspective View of the First Hollow Shaft (Side Inlet Configuration)

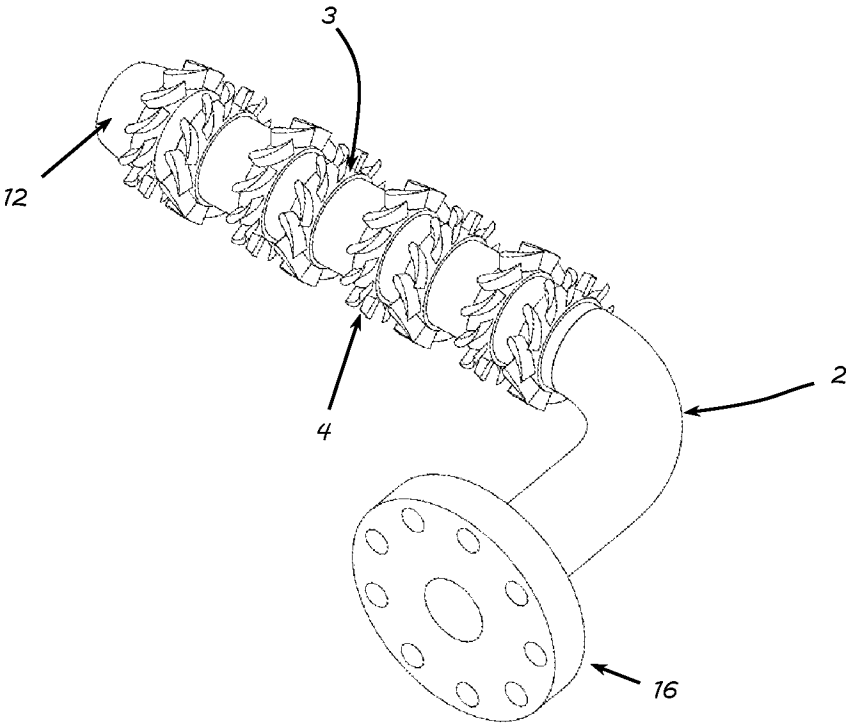
FIG. 15: Perspective View of the First Hollow Shaft Showing four sets of Stator and Turbine Blades

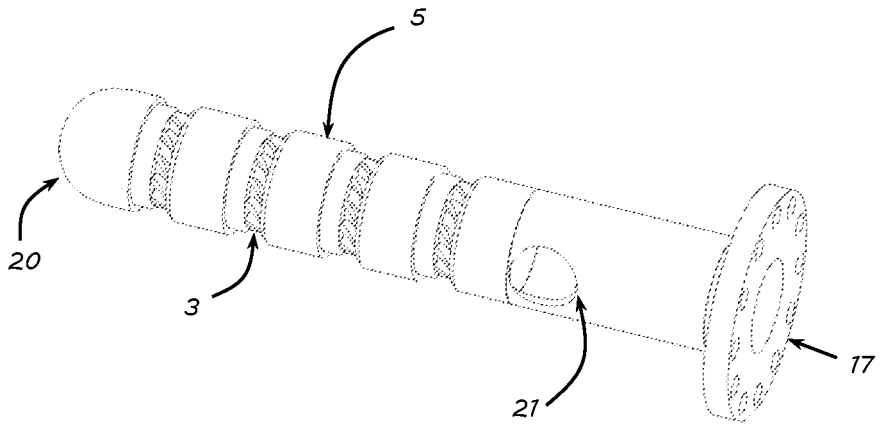
FIG. 16: Perspective View of the External Hollow Shaft of the artifact configured with motive fluid external outlet Showing four sets of Stator
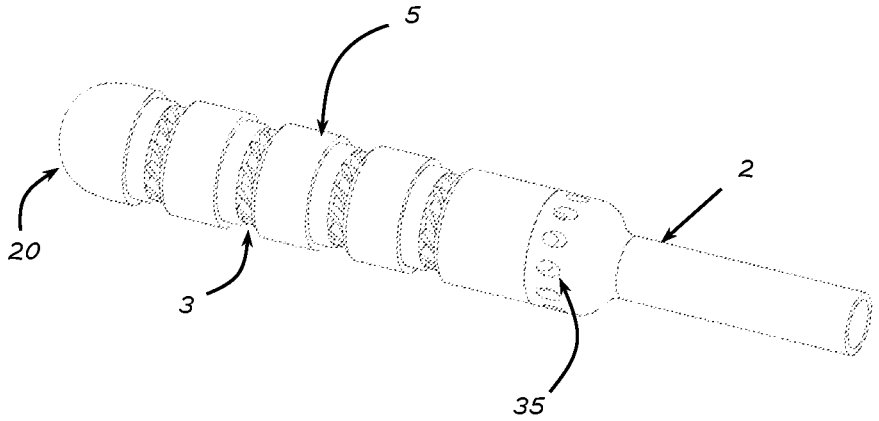
FIG. 17: Perspective View of the Second Hollow Shaft of the artifact configured with motive fluid internal outlet Showing four sets of Stator

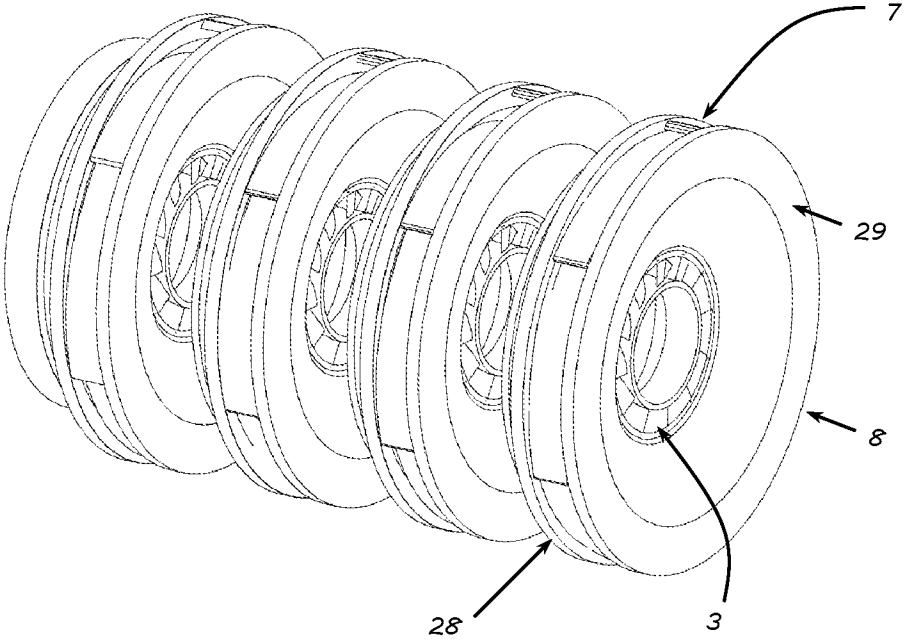
FIG. 18: Perspective View of four Sets of Rotor Assembly

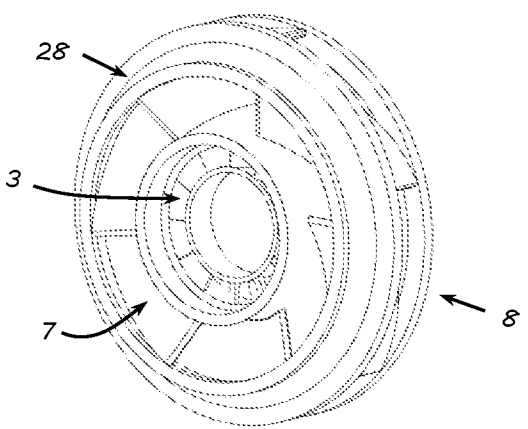
FIG. 20: Perspective Front View of One Rotor Assembly
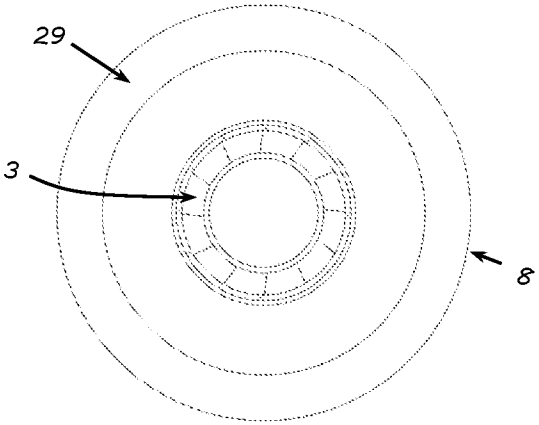
FIG. 22: Back View of One Rotor Assembly
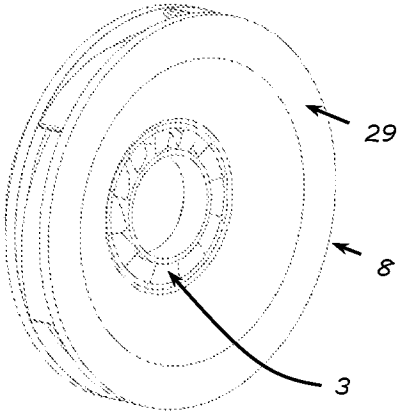
FIG. 19: Perspective Back View of One Rotor Assembly
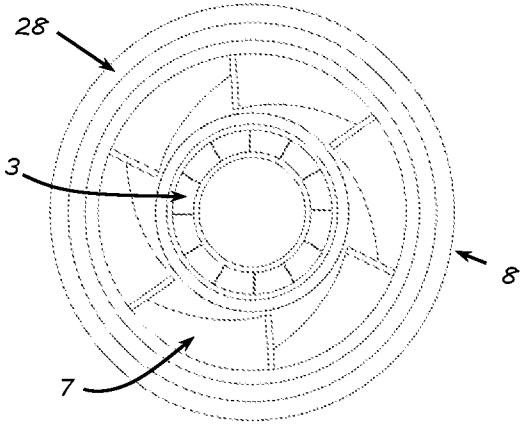
FIG. 21: Front View of One Rotor Assembly

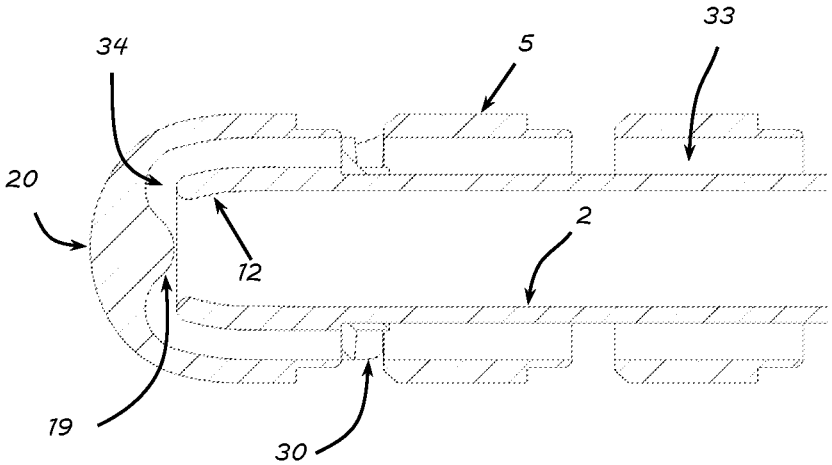
FIG. 23: Cross Section Plane A-A of the First and Second Hollow Shaft showing the Pump Hub, Prong, Nozzle and One Turbine
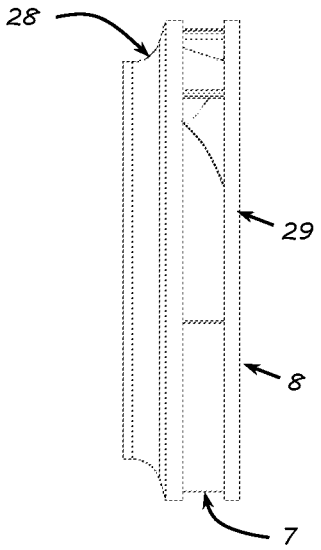
FIG. 24: Side View of One Rotor Assembly

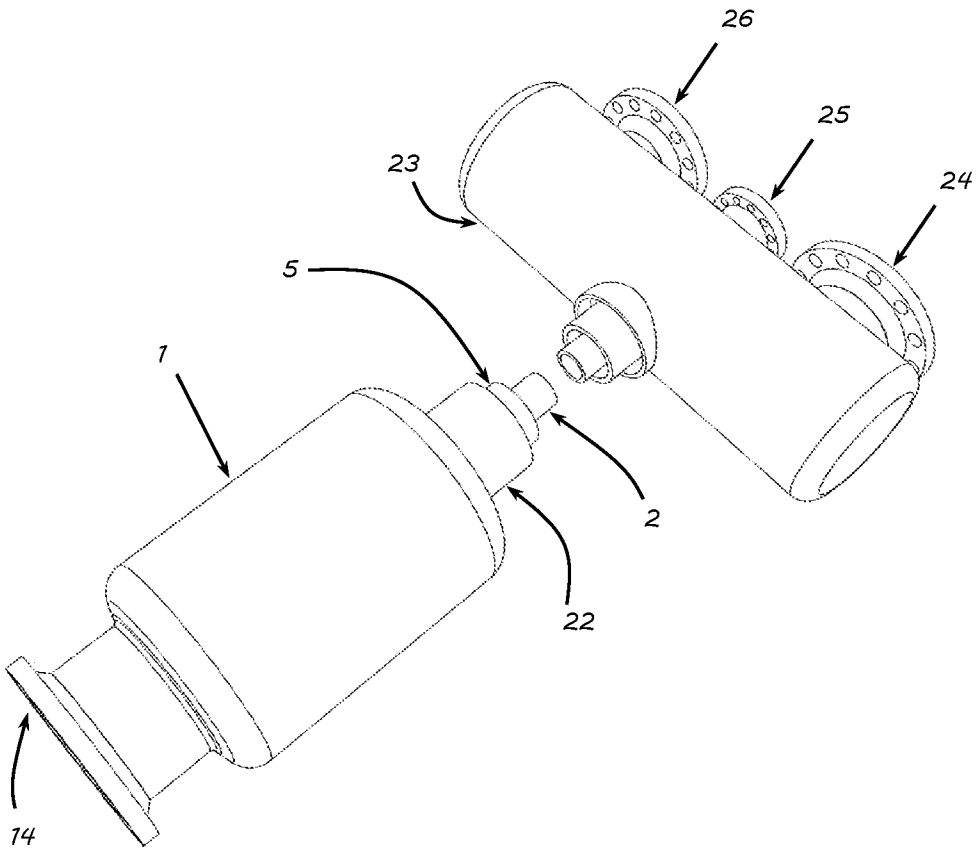
FIG. 25: Perspective View of the Artifact with Concentric Conductors going to a Discharge Manifold

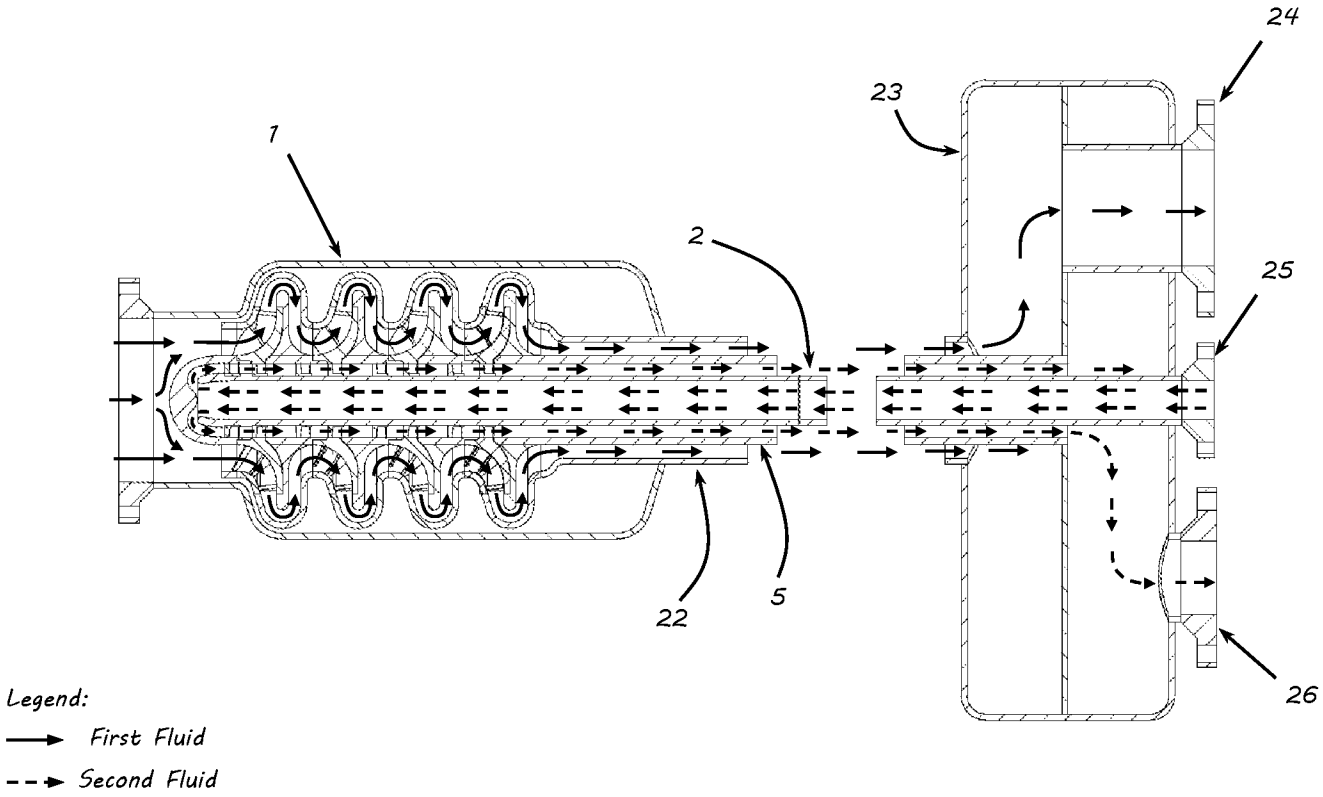
FIG. 26: Cross Section Plane A-A of the Artifact with Concentric Conductors going to a Discharge Manifold

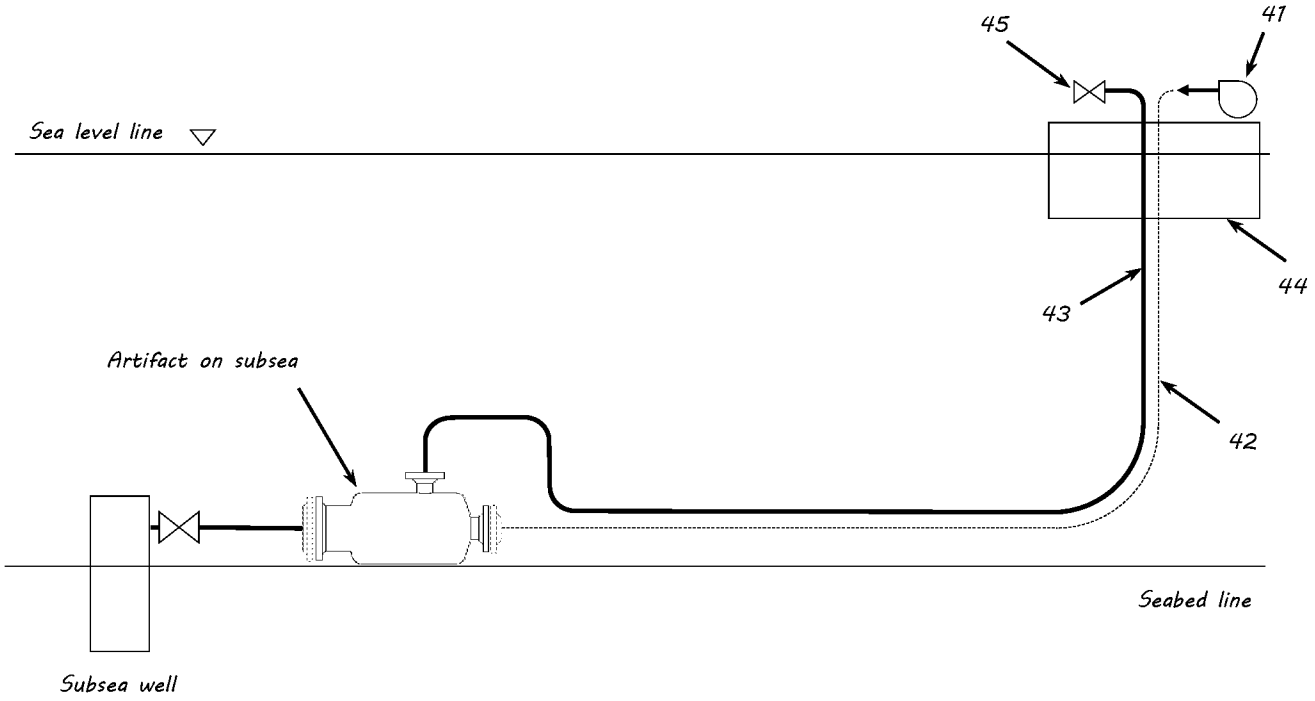
FIG. 27: Schematic Representation as a whole of the Flow Booster Cell System, Including Surface Pump, Motive Fluid Pipeline and the Flow Booster Cell artifact on the seabed

FLOW BOOSTER CELL

The object of the present invention is to create and put together the elements necessary to supply boosting energy in a flowline or different shaped recipients containing motionless fluid, hereinafter also referred interchangeably as the first fluid, or drawn fluid, or static fluid, or relative slow-motion fluid. The present invention provides a motive force through an artifact, hereinafter also referred interchangeably as the boosting artifact, that can be fabricated with few mobile parts and assembled as necessary according to the process where the artifact would be installed. To operate, the artifact requires a source of fluid supply acting as motive fluid, hereinafter also referred interchangeably as the second fluid or drawer fluid, in order to induce the movement of the first fluid.

The rotating element of the artifact is a rotor assembly, hereinafter also referred interchangeably as rotor, or concentric array of blades; with two different concentric and coplanar arrays of blades, one internal and another external. The internal array of blades, hereinafter also referred interchangeably as turbine, works as a turbine; while the external array of blades, hereinafter also referred interchangeably as pump impellers, or pump, or impeller, works as a pump. The given name to the whole group of components comprising the rotor assembly with concentric hollow shafts, or solid shaft, cavities, and other static elements described later in this specification, put together with the body of the artifact, is Flow Booster Cell, hereinafter also referred interchangeably as, flow cell, or cell. Multiple cells can be arranged in series to increase the boosting capacity of the artifact.

The artifact can be designed and manufactured with different purposes in different versions depending on final use or the process to be handled. What differentiate the versions of design and manufacturing of the artifact are the ways in which are designed the motive fluid inlet to enter the artifact, and the motive fluid outlet to exit the artifact. The motive fluid used to activate the artifact, can enters the artifact in different ways; one way is through a dedicated pressure pipe installed parallel and concentric to the artifact, hereinafter also referred interchangeably as pressure pipe, or first hollow shaft, or internal hollow shaft, or inner hollow shaft. This dedicated pipe can enter the artifact from the side or axially. The alternative way the second fluid enter the artifact is through an array of hollow stators, hereinafter also referred interchangeably as virtual stators, wherein the hollow stators are connected to an external scroll case installed around the body of the artifact.

The motive fluid used to activate the artifact, can exit the artifact in different ways; one way is through a delivery pipe having larger diameter than the internal hollow shaft, also installed parallel and concentric to the artifact, hereinafter also referred interchangeably as the delivery pipe, second hollow shaft, or external hollow shaft, or outer hollow shaft; wherein the motive fluid travels throughout the second hollow shaft and exits the artifact separately from the drawn fluid; the name given to this way for the second fluid to exit the artifact is external outlet. Another way is throughout an array of internal discharge nozzles, located at the end of the external hollow shaft, wherein the motive fluid is discharged in the first fluid discharge chamber, to exit the artifact together with the drawn fluid; the name given to this way to for the second fluid to exit the artifact is internal outlet.

In the version where the motive fluid is introduced into the artifact throughout the internal hollow shaft, the motive fluid is directed toward a prong located in an expansion chamber, located at the end of the internal hollow shaft; wherein the motive fluid expands and turns 180 degrees toward the external hollow shaft. The internal hollow shaft can be provided with additional internal nozzles located along the shaft if the motive fluid is desired or requires to be discharged at different levels where different turbines are positioned. In the version where the motive fluid is introduced throughout the virtual stators, the motive fluid is directed toward the expansion chamber with no prong, wherein the motive fluid expands and turns about 90 degrees toward the external hollow shaft.

The movement of the internal array of blades is induced by the second fluid entering through the second hollow shaft, or thought the virtual stators, when the second fluid hits the internal array of blades of the rotor assembly. The movement of the external array of blades is induced by the movement of the internal array of blades of the rotor. The movement of the first fluid is induced by the rotation of the pump impeller. The resulting movement of the first fluid is axial or parallel to the body of the artifact. The internal hollow shaft can be configured to enter the artifact from the side or axially.

The present invention can be utilized in different applications, and different locations or environments, including onshore, offshore (Shallow and Deepwater), or underground, and can be placed in different positions, including vertical and horizontal, to support the transportation of fluids. Some of the applications include the transportation of fluids in flowlines, pipes, wells, mines, tanks, raisers, etc. The invention can be manufactured in different sizes and shapes to fit the system requirements. It can be connected to a pipe, or a hose coming from any other source and operated with any fluid supply such as gas or liquid according to the final purpose.

CROSS-REFERENCE TO RELATED APPLICATIONS

The present invention can be used as a booster pump to support the transportation of low-pressure fluid systems, heavy density, or viscous fluids. The second fluid can be diverse, with a wide range of densities and viscosities, including gas and liquids.

STATEMENT REGARDING FEDERALLY SPONSORED RESEARCH OR DEVELOPMENT

Not Applicable

REFERENCE TO A "SEQUENCE LISTING," A TABLE, OR A COMPUTER PROGRAM LISTING APPENDIX SUBMITTED ON A COMPACT DISC

Not Applicable

BACKGROUND OF THE INVENTION

1. Field of the Invention

The present invention is related with the use of a rotor with an array of coplanar and concentric internal and external blades arranged as a flow booster cell inside a cylindrical housing body, to exert force on a motionless or static fluid. The flow booster cell comprises the rotor assembly, the diffuser, the return vane, the turbine stators, the body or case of the artifact, the pump hub, the first fluid discharge chamber, the internal hollow shaft, the internal hollow shaft nozzle, the external hollow shaft, the first fluid suction chamber, and the second fluid discharge chamber. The given name to a portion of these elements comprising only the rotor assembly, the diffuser, and the return vane is cell assembly.

The cell assembly can be multiplied and installed in series inside the artifact as many times as necessary to meet the boosting requirements of the process. The artifact can be sized conveniently according to the number of necessary cell assemblies to be installed in series. The cell assemblies can be manufactured in different sizes and installed in series, according to the requirements of the process; for example, the rotor closer to the first fluid suction chamber of the artifact can be smaller than the other rotors, in order to meet the functionality required. The size of the other rotors can progressively change, increasing or decreasing, conveniently in order to allow the first fluid to be drawn by the pump. The rotor is activated by the second fluid when it hit the internal blades.

The motive fluid can be introduced into the artifact through a scroll case installed around the body of the artifact, wherein the motive fluid is distributed through virtual stators connected to the expansion chamber, toward the external hollow shaft, alternatively the motive fluid can be introduced into the artifact through the internal hollow shaft, which discharges into the expansion chamber; wherein the motive fluid will be directed toward the external hollow shaft; wherein the motive fluid hits the turbine stators and turbine blades, wherein the motive fluid set in motion the turbine. The motive fluid can be discharged in two different ways from the artifact, one way is through the external or separated discharge nozzle connected externally to the body or case of the artifact, wherein the external discharge nozzle is also connected to the external hollow shaft; the alternative way is discharging the fluid through internal discharge nozzles located on the external hollow shaft, directly into the first fluid discharge chamber placed downstream of the last rotor or last compression stage, wherein the second fluid will mixed up with the first fluid; wherein the mixture of fluids will be introduced in the transportation pipeline to be transported to their destinations. If the fluids have different densities, the lighter fluid will reduce the density of the heavier fluid when they mix in the last section of the artifact.

The first fluid and the second fluid can be discharged independently from the artifact, using separated pipes, or using an arrangement of two concentric pipes. A third pipe can be added to the concentric pipe's arrangement, such as the internal hollow shaft, which introduces the second fluid into the artifact, stays inside the second hollow shaft, which transports the second fluid out of the artifact; and these two stays inside the discharge pipe, which transports the first fluid out of the artifact. The three pipes can be connected to three concentric pipelines. The three concentric pipelines will remain concentric, one into the other until the first fluid and second fluid require to be discharged at destination in separated ways, or into a manifold.

The artifact has no direct power source such as electricity connected to it, and it works resembling a propel blades, or a hydraulic turbine, or a gas turbine, moving the concentric arrange of blades or blade assembly at the same velocity. Particularly, the invention applies in the use of boosting any fluid from any pipe, oil flowlines, risers, hose, vessels, etc., no matter their location, or surrounding environment, including onshore, offshore, or underground locations.

The artifact combines the pressure and velocity produced by the rotor blades to move and boost the fluid at higher pressure.

2. Background of the Related Art

The transportation of the fluids in a well, cylindrical vessel or pipe system depends on the pressure at the source or origin of such well, vessel or pipe system. This pressure can be produced by any mean natural or manufactured by man, and it must be enough to transport the fluid from one end to another in the well, vessel or pipe, and in many cases with enough discharge pressure to continue with another downstream process. For example, the transportation of fluids hydrocarbon in a well can involves different kind of technologies to makes the fluid flows to an end point at the surface, generally with a required discharge pressure. Such point can be located at the same level of the production facilities in the case of an onshore field, but it can also be necessary to makes the fluid flows up to a location or dry surface out of the subsea in case of offshore or underground mine facilities. In some cases, the well should have enough pressure to make the fluid arrive to any desired destination. In other cases, the installation of systems such as seabed or mudline booster pumps, help to reduce the backpressure on the well.

There are many ways to produce oil with different systems using booster pump methods. Generally, the system is part of the production facility from the first production date, but others, and particularly in the case of subsea facilities, many systems have single or multiphase pumps connected to the subsea manifolds which are installed since the beginning or far after the first production, in some cases when the reservoir has been depleted. Apart of oil, also gas and other fluids can be produced and introduced in many other ways into the booster pump transportation system.

The current invention can be used in many different situations in which the pressure at the source is insufficient to transport the fluid or when is required to reduce the density or induce movement to a fluid for its transportation, or evacuate a fluid from particular locations, including producing wells, transportation flowlines, transportation pipes or pipelines, confined spaces or vessels, subsea risers, etc.

The use of this artifact only requires a source of another fluid to produce the movement of the rotor with blades to move and pressurize the fluid desired to transport. It does not require direct sources of electrical power, so it can be implemented in many cases where the electrical power has limitations or does not exist.

BRIEF SUMMARY OF THE INVENTION

The object of the present invention is to provide a system artifact that utilizes no direct electrical power to move fluids throughout short or long distances. This is achieved using another fluid (drawer or motive fluid) as a medium at high pressure. The potential energy of the motive fluid is transformed into rotating kinetic energy on a rotor installed inside the artifact body when this hit its blades. The motive fluid may be generally less dense than the motionless fluid, so it can play additional functions such as a solvent that support the dilution or density reduction of the fluid drawn-out, and also it can work as a lifter in the case of gas which will support raising the heavier fluid when is desired that both fluids mix downstream the rotor, in the last section of the artifact. Lowing the density of the drawn fluid will reduce the backpressure at the source, which will make easier the transportation of the motionless fluid.

The invented artifact has an inlet and an outlet for the motive fluid, and a suction for the motionless fluid, and one discharge that can be common for both fluids (the motive fluid and the motionless one) when is desired to discharge both fluids into the same cavity or discharge chamber. The inlet is dedicated to the motive fluid while the suction is dedicated to motionless or drawn fluid. The fluids are not in connection unless it is desired to mix them in the last section or discharge of the artifact. The artifact can be connected through piping or any other connection that allows bringing the drawer fluid until to and out of the artifact. Once the artifact is connected to the motive fluid source, it should be set to the rate and pressure required and placed at the desired location, which can be close or away from the source of fluid to drawn-out. The size, shape of the rotor and its blades, as wells as the exact location of the artifact must be calculated and designed according to the process and fluids requirements. If the fluid to drawn-out is already in slow motion, the artifact should be placed in a convenient location according to the process requirements to boost the fluid pressure, as necessary.

The drawer fluid to be used will depend on the application or process requirements. For most of the oil producing processes, the fluid to use can be gas, but it can be also low-density liquids, including water. For other applications the fluids must be selected according to the process. The fluids can be separated, as required at the destination point, such as any of the separated fluids can be used in a loop as motive fluid, if desired.

The only thing the artifact requires for its operation is a motive fluid, which should have the required properties in according the process to be implemented. In a subsea application the artifact can be placed on the seabed at any depth or onshore, or underground at any point between the production and processing locations. It can also be placed in any location in a manufacturing facility to help to withdraw or evacuate any fluid in different processes.

The operation of the artifact can be done at the source of the motive fluid, where the flowrate and pressure will be set up. The rate and pressure may be eventually adjusted between periods of the time, to adapt the conditions to the process requirements. It can be also combined with control systems according to the processes in the manufacturing, production facilities or flow destination. The position of the artifact can also be adjusted according to the variation of the conditions in the process. This will provide flexibility and continuity for longer periods of operation. The rotor and turbine stators can be installed in series or tandem in the same equipment to increase the boosting capacity of the system as much as necessary, also different equipment can be installed in series along the transportation system.

BRIEF DESCRIPTION OF THE DRAWINGS

To easier understand the nature and object of the current invention, reference is made to the accompanying drawings, in which:

FIG. 1 illustrates an external isometric view of the artifact in horizontal position, configured with motive fluid entering the artifact through the internal hollow shaft and motive fluid leaving the artifact through external outlet, showing four nozzles: the first fluid suction, the first fluid discharge, the second fluid inlet, and the second fluid outlet. This figure also shows the section planes A-A (horizontal) and B-B (vertical) to be used along this document for detailed description of the artifact.

FIG. 2 illustrates an external perspective view of the artifact configured with motive fluid entering the artifact through the hollow stators and motive fluid leaving the artifact through external outlet, showing the scroll case and the scroll nozzle. The figure also shows the first fluid suction, the first fluid discharge, the artifact body casing, and the scroll inlet.

FIG. 3 illustrates another external perspective of the artifact in the version with hollow stators, configured with motive fluid external outlet, showing the scroll case and the scroll nozzle. The figure also shows the first fluid suction, the first fluid discharge, the artifact body casing, the second fluid outlet, and the scroll inlet.

FIG. 4 illustrates a top view cross-section of the artifact configured with motive fluid entering the artifact through the internal hollow shaft and motive fluid leaving the artifact through external outlet, including indication of the movement directions of the motive and drawn fluids. It also shows a cross-section of the cell assembly and rotors with partial views of its external and internal blades, in an arrangement of four boosting stages. The figure also shows the sections of the internal hollow shaft, entering through the side of the artifact, and the external hollow shaft in axial position.

FIG. 5 illustrates a cross-section on the plane B-B of the artifact configured with motive fluid entering on the side of artifact through the internal hollow shaft and motive fluid leaving the artifact through external outlet, and drawn fluid lateral or side discharge, including indication of the movement directions of the motive and drawn fluids. The movement of the motive fluid is represented by dashed arrows, while the movement of the drawn fluid is represented by continue arrows. The figure also shows the sections of the first and second hollow shafts, and the section of four cell assemblies placed in series.

FIG. 6 illustrates a cross-section on the plane A-A of the artifact configured with motive fluid entering the artifact through the internal hollow shaft, and configured with motive fluid inlet and outlet, and drawn fluid discharge, all in straight or axial connection with concentric conductors or pipes, including indication of the movement directions of the motive and drawn fluids. It also shows the sections of the first and second hollow shafts, and the section of four cell assemblies placed in series.

FIG. 7 illustrates a cross-section of the artifact configured with motive fluid entering the artifact through the internal hollow shaft and motive fluid leaving the artifact through internal outlets, and configured with motive fluid inlet, and drawn fluid discharge, both in straight or axial connection with concentric conductors or pipes, including indication of the movement directions of the motive and drawn fluids. On the figure can be seen how the motive fluid exit throughout internal nozzles installed on the external hollow shaft, and going toward the discharge chamber to join the drawn fluid at the discharge. It also shows the sections of the internal and external hollow shafts, and the section of four cell assemblies placed in series.

FIG. 8 illustrates a side view cross-section of the artifact configured with motive fluid entering the artifact through the hollow stators and motive fluid leaving the artifact through external outlet, including indication of the movement directions of the motive and drawn fluids. It also shows a cross-section of the cell assembly and rotors with partial views of its external and internal blades, in an arrangement of four boosting stages. The figure also shows the sections of the scroll case, the hollow stators, the internal solid shaft, and the external hollow shaft, wherein the hollow stators extend from the scroll case until the hub of the pump, wherein the motive fluid travel through the hollow stators toward the expansion chamber, wherein the motive fluid is directed toward the external hollow shaft.

FIG. 9 illustrates a side view of internal elements of the artifact in horizontal position, configured with motive fluid entering on the side of the artifact through the internal hollow shaft and motive fluid leaving the artifact through external outlet, showing four rotor assemblies, which indicates four boosting stages. The artifact can be assembled with as many rotors assembly are necessary to meet the boosting requirements. The figure also illustrates portions of the external views of the first and second hollow shafts. The length of these two shafts can be increased as long as necessary to carry as many rotors as required in the boosting process.

FIG. 10 illustrates a cross-section view of the FIG. 9, showing the first and second hollow shafts, and also showing the sections of four sets of rotor assemblies, the turbine stators, turbine and pump impeller. The shape of the blades and impeller can be designed according to the nature of the fluid to be handle, including single phase and multiphase fluids.

FIG. 11 illustrates a perspective view of the artifact showing one cell assembly mounted on the internal and external hollow shafts, inside a section view of the case or body of the artifact. The figure also shows the perspective of the first hollow shaft entering from the side of the artifact, and a portion of the second hollow shaft. The cell assembly can be installed in series on the shafts, as many times as needed to meet the boosting process requirements. In the figure can be appreciated that the moving part of the artifact is the rotor.

FIG. 12 shows a cross-section of the FIG. 11 showing one cell assembly comprising turbine blades, pump impeller, rotor assembly, diffuser, and return vane, all together mounted on the internal and external hollow shafts, all inside the body of the artifact. All together make a flow booster cell.

FIG. 13 shows a perspective view of the internal hollow shaft in configuration with lateral or side inlet. The figure also shows the internal hollow shaft nozzle.

FIG. 14 is a perspective view of the internal hollow shaft in configuration with straight inlet. The figure also shows the internal hollow shaft nozzle.

FIG. 15 illustrates a perspective view of the internal hollow shaft in configuration with lateral inlet. The figure also shows the perspective view of turbine stators and turbine blades in a set of four, which means four boosting stages, mounted on the internal hollow shaft.

FIG. 16 illustrates a perspective view of the external hollow shaft in configuration with straight or axial outlet. The figure also shows the perspective view of turbine blades in a set of four, which means four boosting stages, mounted on the internal hollow shaft, not shown in the picture. The figure also shows the internal hollow shaft opening on the side of the external hollow shaft, wherein the opening is only necessary when the internal hollow shaft inlets from the side or laterally into the artifact.

FIG. 17 illustrates a perspective view of the external hollow shaft configured with motive fluid internal outlet. The figure also shows the perspective view of turbine blades in a set of four, which means four boosting stages, mounted on the internal hollow shaft. The figure also shows the internal hollow shaft in straight or axial position.

FIG. 18 illustrates a perspective view of a set of four rotor assemblies and its parts. The rotor assembly can be multiplied as many times as necessary to meet the boosting process requirements. Every rotor means one boosting stage.

FIG. 19 illustrates a perspective back view of the rotor assembly.

FIG. 20 illustrates a perspective front view of the rotor assembly.

FIG. 21 illustrates the front view of the rotor assembly.

FIG. 22 illustrates the back view of the rotor assembly.

FIG. 23 illustrates a partial cross-section of the first and second hollow shafts, showing the internal hollow shaft nozzle, the pump hub, the expansion chamber, and the prong. Wherein from the internal hollow shaft, the motive fluid passes to the expansion chamber after been accelerated in the internal hollow shaft nozzle, the bottom of the expansion chamber is hyperbolic geometrically shaped, wherein the motive fluid expands uniformly when it impacts with the internal hyperbolic geometry expansion chamber prong, spreading the fluid uniformly before it enters the motive fluid stream chamber located between the two hollow shafts. The figure also shows a portion of the turbine blades.

FIG. 24 illustrates the side view of the rotor assembly.

FIG. 25 illustrates a perspective view of the artifact and a discharge manifold. In this view the artifact is configured with inlet and discharge throughout concentric pipes or conductors, wherein these conductors can be extended to cover the distance between the artifact and the manifold. The manifold shows the three nozzles, the first fluid manifold discharge nozzle, the second fluid inlet nozzle, and the second fluid outlet nozzle. This configuration is applicable when the motive fluid enters the artifact through the hollow internal shaft.

FIG. 26 illustrates a cross-section of the artifact shown in FIG. 25, wherein the artifact is configured with motive fluid inlet and outlet, and drawn fluid discharge, all in an arrangement of straight or axial concentric pipes or conductors, including indication of the movement directions of the motive and drawn fluids, in connection with the discharge manifold. The figure also shows the cross-section of the discharge manifold, indicating the movement direction of the first and second fluids. It also shows the sections of the first and second hollow shafts, and the section of four cell assemblies placed in series inside the artifact.

FIG. 27 shows a schematic representation as a whole of the flow booster cell system configured with motive fluid internal outlet, placed in a subsea environment and operated from a floating facility located at sea level.

DETAILED DESCRIPTION OF THE INVENTION

Referring now in a detailed manner to the figures above, in which the numerals identify the parts of the artifact; the FIG. 1, represents a perspective view of the boosting artifact of the present invention, configured with motive fluid entering the artifact through the internal hollow shaft and motive fluid leaving the artifact through external outlet, including the identification of the two planes A-A and B-B used along this specification to better describe the internal parts shown in different cross-sections. In this view are shown the body 1 of the artifact, the first fluid suction 14 and the first fluid discharge 15 of the artifact, which can be jointed through different ways of connections, such as a flange, thread ends, welded ends, or any other connection to a pipe or vessel. It also shows an external view of the second fluid inlet 16 and second fluid outlet 17, through which the second fluid enters and exits the artifact respectively.

FIG. 2 represents a perspective view of the boosting artifact of the present invention, configured with motive fluid entering the artifact through the hollow stators 36, and motive fluid leaving the artifact through external outlet. In this view are shown the body 1 of the artifact, the first fluid suction 14 and the first fluid discharge 15 of the artifact, which can be jointed through different ways of connections, such as a flange, thread ends, welded ends, or any other connection to a pipe or vessel. It also shows an external view of the scroll case 37, wherein the motive fluid is distributed to the hollow stators 36, wherein the hollow stators are connected to the pump hub 20, wherein the motive fluid enters the artifact. The figure shows also the scroll nozzle 39 and the scroll inlet 40, wherein is connected the pipe transporting the motive fluid to the artifact.

FIG. 3 illustrates another external perspective of the artifact in the version with hollow stators, configured with motive fluid external outlet, showing the scroll case 37 and the scroll nozzle 39. The figure also shows the first fluid suction 14, the first fluid discharge 15, the artifact body 1, the second fluid outlet 17, and the scroll inlet 40.

FIG. 4 illustrates a cross-section on the plane A-A of the artifact configured with motive fluid entering the artifact through the hollow stators 36, and motive fluid leaving the artifact through external outlet. It shows the direction of the motive and drawn fluids inside the artifact. The continue line arrows show the approximate direction of the drawn fluid while the dashed line arrows show the approximate direction of the motive fluid. It can be seen the cross-section of the body 1, the motive fluid inlet 16 located on the side of the artifact, how the motive fluid enters the internal hollow shaft 2 and turns one hundred eighty degrees in the expansion chamber 33 to enter into the external hollow shaft 5 where the motive fluid is directed to the turbine stators 4 before it hits the turbine blades 30, wherein enters the motive fluid discharge chamber 31, wherein is discharged toward the motive fluid outlet 17. When the motive fluid hits the turbine blades 30 it will induce movement to the turbine 3, wherein the turbine 3 will induces movement on the pump impeller 6, wherein the pump impeller 6 will exerts a suction effect onto the motionless fluid directing the fluid throughout the diffuser 9, and then throughout the return vane 10 of the cell assembly, compressing the fluid in every stage until it reaches its maximum pressure in the discharge chamber 11. The figure also shows the drawn fluid suction 14, the artifact suction chamber 13, a partial view of the pump impeller blades 7, and the pump hub 20.

FIG. 5 illustrates a cross-section on the plane B-B of the artifact configured with motive fluid external outlet. It shows the direction of the motive and drawn fluids inside the artifact. The continue line arrows show the approximate direction of the drawn fluid while the dashed line arrows show the approximate direction of the motive fluid. In the figure can be seen the drawn fluid discharge 15 located on the top of the artifact, wherein the motive fluid enters the internal hollow shaft 2, wherein the motive fluid will turn one hundred eighty degrees in the expansion chamber 34 to get into the external hollow shaft 5, wherein the fluid is directed to the motive fluid stream chamber 33, wherein are located the turbine stators 4, and the turbine blades 30, wherein the motive fluid is discharged in the motive fluid discharge chamber 31, wherein the motive fluid is discharged toward the motive fluid outlet 17. When the motive fluid hits the turbine blades 30 it will induce movement on the turbine 3, wherein the turbine 3 will induces movement of the pump impeller 6, wherein the pump impeller 6 will exerts a suction effect onto the motionless fluid directing the fluid throughout the diffuser 9, and then throughout the return vane 10 of the cell assembly, compressing the fluid in every stage until it reaches its maximum pressure in the discharge chamber 11. The figure also shows the drawn fluid suction 14, the artifact suction chamber 13, a partial view of the pump impeller blades 7, and the pump hub 20.

As in the previous figure, FIG. 6 illustrates a cross-section on the plane A-A of the artifact configured with motive fluid external outlet and concentric arrange of pipes connections. It shows the direction of the motive and drawn fluids inside the artifact. The continue line arrows show the approximate direction of the drawn fluid while the dashed line arrows show the approximate direction of the motive fluid. The figure shows the motive fluid entering through an axial pipe directly connected to the internal hollow shaft 2, in concentric arrangement with the external hollow shaft 5, wherein the motive fluid exits the artifact; wherein these two pipes are in concentric arrangement with the discharge pipe 22, wherein the drawn fluid is discharged. In the figure can be seen how the motive fluid enters the internal hollow shaft 2 and turn one hundred eighty degrees in the expansion chamber 34, to get into the external hollow shaft 5, wherein the fluid is directed to the motive fluid stream chamber 33, wherein are located the turbine stators 4, and the turbine blades 30, wherein the motive fluid is discharged in the motive fluid discharge chamber 31, wherein is discharged toward the pipe connected to the external hollow shaft 5. When the motive fluid hits the turbine blades 30 it will induce movement on the turbine 3, wherein the turbine 3 will induces movement of the pump impeller 6, wherein the pump impeller 6 will exerts a suction effect onto the motionless fluid directing the fluid throughout the diffuser 9, and then throughout the return vane 10, compressing the fluid in every stage until it reaches its maximum pressure in the discharge chamber 11. The figure also shows the drawn fluid suction 14, the artifact suction chamber 13, a partial view of the pump impeller blades 7, and the pump hub 20.

As in the previous figure, FIG. 7 illustrates a cross-section on the plane B-B of the artifact configured with motive fluid internal outlet and concentric arrange of pipes connections. It shows the direction of the motive and drawn fluids inside the artifact. The continue line arrows show the approximate direction of the drawn fluid while the dashed line arrows show the approximate direction of the motive fluid. The figure shows the motive fluid entering through an axial pipe directly connected to the internal hollow shaft 2, in concentric arrangement with the external hollow shaft 5, wherein the motive fluid exits the artifact; wherein these two pipes are in concentric arrangement with the discharge pipe 22, wherein the drawn fluid is discharged. In the figure can be seen how the motive fluid enters the internal hollow shaft 2 and turn one hundred eighty degrees in the expansion chamber 34, to get into the external hollow shaft 5, wherein the fluid is directed to the motive fluid stream chamber 33, wherein are located the turbine stators 4, and the turbine blades 30, wherein the motive fluid is discharged in the motive fluid discharge chamber 31, wherein is discharged toward the internal discharge nozzles 35; wherein the motive fluid is discharged into the discharge pipe 22.

FIG. 8 illustrates a cross-section on the plane B-B of the artifact configured with motive fluid entering the artifact through the hollow stators 36, and motive fluid leaving the artifact through external outlet. It shows the direction of the motive and drawn fluids inside the artifact. The continue line arrows show the approximate direction of the drawn fluid while the dashed line arrows show the approximate direction of the motive fluid. It can be seen the cross-section of the body 1, the scroll case 37, wherein the motive fluid enters the artifact, wherein the motive fluid is distributed to the hollow stators 36, which are connected to the pump hub 20, wherein the motive fluid is expanded in the expansion chamber 34, from where the motive fluid passes to the motive fluid stream chamber 33, located between the internal solid shaft 38 and the external hollow shaft 5, where the motive fluid is directed to pass throughout the turbine stators 4 before it hits the turbine blades 30, from where the motive fluid passes to the motive fluid discharge chamber 31, wherein is discharged toward the motive fluid outlet 17. When the motive fluid hits the turbine blades 30 it will induce movement on the pump impeller 6, wherein the pump impeller 6 will exerts a suction effect onto the motionless fluid directing the fluid throughout the diffuser 9, and then throughout the return vane 10 of the cell assembly, compressing the fluid in every stage until it reaches its maximum pressure in the discharge chamber 11. The figure also shows the drawn fluid suction 14, the artifact suction chamber 13, and a partial view of the pump impeller blades 7, and the drawn fluid discharge 15.

FIG. 9 represents a horizontal top view of internal elements of the boosting artifact of the present invention configured with motive fluid external outlet. This figure shows the motive fluid inlet 16, and motive fluid outlet 17; an external partial view of the internal hollow shaft 2, wherein the motive fluid enters the artifact, an external view of the external hollow shaft 5, and the pump hub 20. It also shows an arrangement of four rotor assemblies 8, wherein can also be seen a partial view of the pump impeller blades 7.

FIG. 10 illustrates a cross-section of FIG. 9 on the plane A-A, where can be seen cross-sections of the motive fluid inlet 16, wherein the motive fluid enters the artifact, and the motive fluid outlet 17, wherein the motive fluid exits the artifact. The figure also shows the motive fluid inlet chamber 32, wherein the motive fluid gain velocity and pressure after entering the artifact; it also shows partial views of the turbine stators 4, used to keep the motive fluid parallel to the axis of the artifact before it hits the turbine 3. The figure also shows the internal hollow shaft nozzle 12, wherein the motive fluid pressure is converted to kinetic energy. From the internal hollow shaft nozzle 12, the motive fluid then passes to the expansion chamber 34, which bottom is hyperbolic geometrically shaped, wherein the motive fluid expands uniformly when it impacts with the internal hyperbolic geometry expansion chamber prong 19, spreading the fluid uniformly before it enters the motive fluid stream chamber 33. The figure also shows cross-sections of the pump impellers 6, the rotor assembly 8, the pump hub 20, the internal hollow shaft 2, the external hollow shaft 5, and a partial view of the pump impeller blades 7.

FIG. 11 shows a perspective view of a flow booster cell, showing a single cell assembly 27 inside half of the artifact, also showing the pump hub 20, and a partial view of the body 1 of the artifact, the drawn fluid suction 14, the internal hollow shaft 2, and the external hollow shaft 5. It also shows the motive fluid inlet 16 and the drawn fluid outlet 17.

The FIG. 12 shows a cross-section view of the flow booster cell, showing a single cell assembly 27 inside the artifact. It can be seen cross-sections of the pump hub 20, and partial views of the body 1 of the artifact, the drawn fluid suction 14, the internal hollow shaft 2, and a portion of the external hollow shaft 5. It also shows the motive fluid inlet 16 and the drawn fluid outlet 17. In the section are also shown the turbine blades 30, and the pump impeller 6, the motionless fluid diffuser 9, and the return vane 10. The figure also shows the sections of the turbine stators 4, the rotor assembly 8, and a partial view of the pump impeller blades 7.

FIG. 13 shows a perspective view of the internal hollow shaft 2 in position to entering laterally or from the side of the artifact. It also shows the motive fluid inlet 16. The figure also shows the internal hollow shaft nozzle 12.

FIG. 14 shows a perspective view of the internal hollow shaft 2 in position to entering axially into the artifact. It can be seen also the motive fluid inlet 16. The figure also shows the internal hollow shaft nozzle 12.

FIG. 15 shows a perspective view of the internal hollow shaft 2 in position to entering laterally or from the side of the artifact. It is also shown the motive fluid inlet 16. The figure also shows a portion of the internal hollow shaft nozzle 12, a perspective view of a set of four turbines 3, and a perspective view of four turbine stators 4 arrangements.

FIG. 16 shows a perspective view of the external hollow shaft 5 in position to exit axially from the artifact connected through the motive fluid outlet 17. The figure also shows the pump hub 20, a set of four turbines 3, and the internal hollow shaft opening 21.

FIG. 17 shows a perspective view of the external hollow shaft 5 of the artifact configured with motive fluid internal outlet and concentric arrange of pipes connections. In the figure can be seen the internal discharge nozzles 35. The figure also shows the pump hub 20, a set of four turbines 3, and a portion of the internal hollow shaft 2 in axial position.

The FIG. 18 shows a perspective view of four rotor assemblies 8, wherein can be seen the assembly components such as the front shroud 28, the pump impeller blades 7, the turbines 3, and the rear shroud 29.

The FIG. 19 shows a perspective back view of one rotor assemblies 8, wherein can be seen the assembly components such as the turbines 3, and the rear shroud 29.

The FIG. 20 shows a perspective front view of one rotor assemblies 8, wherein can be seen the assembly components such as the front shroud 28, the turbines 3, and the pump impeller blades 7.

The FIG. 21 shows a front view of one rotor assemblies 8, wherein can be seen the assembly components such as the front shroud 28, the turbines 3, and the pump impeller blades 7.

The FIG. 22 shows a back view of one rotor assemblies 8, wherein can be seen the assembly components such as the rear shroud 29, and the turbines 3.

The FIG. 23 shows a portion of the cross-section view of the external hollow shaft 5, the motive fluid expansion chamber 34, which bottom is hyperbolic geometrically shaped, wherein the motive fluid expands uniformly when it impacts with the internal hyperbolic geometry expansion chamber prong 19, spreading the fluid uniformly before it enters the motive fluid stream chamber 33. The figure also shows cross-sections of the pump hub 20, the internal hollow shaft 2, the external hollow shaft 5, and a partial view of the turbine blades 30.

The FIG. 24 shows a side view of one rotor assemblies 8, wherein can be seen the assembly components such as the rear shroud 29, the front shroud 28, and the pump impeller blades 7.

FIG. 25, represents a perspective view of the boosting artifact of the present invention, configured with motive fluid external outlet, and concentric arrange of pipes connections. In this view are shown the body 1 of the artifact, the first fluid suction 14 and a portion of the external hollow shaft 5, a portion of the discharge pipe 22, and a portion of the internal hollow shaft 2, wherein all of them can be jointed through different ways of connections, such as a flange, thread ends, welded ends, or any other connection to a pipe or discharge manifold 23. The figure also shows three concentric pipelines in connection with the discharge manifold 23, wherein the discharge manifold 23 have three nozzles, wherein one nozzle is the drawn fluid manifold discharge nozzle 24, another is the motive fluid manifold inlet nozzle 25, and another is the motive fluid manifold outlet nozzle 26.

FIG. 26 illustrates a cross-section of the artifact configured with motive fluid inlet and outlet, and drawn fluid discharge, all in straight connection with concentric pipes or conductors, including indication of the movement directions of the motive and drawn fluids. The figure shows cross-sections of the body 1 of the artifact, and the discharge manifold 23, wherein the discharge manifold 23 have three nozzles, wherein one nozzle is the drawn fluid manifold discharge nozzle 24, another is the motive fluid manifold inlet nozzle 25, and another is the motive fluid manifold outlet nozzle 26. It also shows the sections of the internal hollow shaft 2, and external hollow shaft 5, the discharge pipe 22, and the section of four cell assemblies 27 placed in series.

FIG. 27 shows Schematic Representation as a whole of the Flow Booster Cell System circuit on an offshore environment, including: Surface Pump 41 which will impulse the motive fluid from a remote location, Motive Fluid Pipeline 42 which will transport the motive fluid, production pipeline 43, a floating facility 44 where all surface facilities are installed, the production discharge 45, and the Flow Booster Cell Artifact configured with motive fluid internal outlet, placed on the seabed surface. When the boosting artifact is configured with external outlet, it can be incorporated an additional pipeline for the discharge of the motive fluid segregated from the production pipeline 43. The same architecture may be used for applications onshore or underground or adapted according to the process requirements.

The invention claimed is:

1. An artifact for boosting fluids comprising:

an streamlined cylindrical housing having a first fluid suction and a first fluid discharge, also having a second fluid inlet and a second fluid outlet, the housing further having an internal array of two concentric hollow shafts, an inner hollow shaft and an outer hollow shaft;

the inner hollow shaft having an end in communication with the second fluid inlet, wherein the second fluid is introduced into the artifact through the inner hollow shaft; the inner hollow shaft further having a nozzle at the opposite end of the second fluid inlet; wherein the second fluid is accelerated;

a hyperbolic geometrically shaped expansion chamber located after the inner hollow shaft nozzle, the hyperbolic geometry expansion camber having a prong, the prong being contacted by the second fluid exiting the inner hollow shaft nozzle, wherein the prong split up the second fluid, disseminating uniformly the second fluid in the hyperbolic geometrically shaped expansion chamber, wherein the second fluid portions change direction toward the outer hollow shaft;

the outer hollow shaft having an end in communication with the hyperbolic geometrically shaped expansion chamber, the outer hollow shaft further having an internal diameter bigger than the external diameter of the inner hollow shaft, wherein a space is created between the inner and the outer hollow shafts, wherein this space forms the second fluid discharge chamber, wherein the second fluid passes from the hyperbolic geometrically shaped expansion chamber to the second fluid discharge chamber; wherein the second fluid is discharged before it exits the artifact;

a rotor assembly comprising two different concentric and coplanar arrays of blades connected each other, one internal and another external, each blade having a foil shape which allows the fluid increase velocity when it is in contact with the blades; wherein the internal array of blades is designed to works as a turbine; while the external array of blades is designed to works as a pump impeller; wherein the pump impeller can be designed to boost single phase or multiphase fluids; wherein the internal array of blades and the external array of blades rotate when the second fluid make contact with the internal array of blades; wherein the rotation of the external array of blades transmit the energy delivered by the second fluid on the internal array of blades to the first fluid, wherein the first fluid is moved forward; wherein the rotor assembly is mounted on the inner and outer hollow shafts; wherein the internal array of blades rotate in contact with the inner hollow shaft, while the external array of blades rotate in contact with the outer hollow shaft;

a flow booster cell assembly comprising the rotor assembly, a diffuser; which is a non-rotating cavity whose flow area increases in the direction of flow, located after the external array of blades outlet; wherein the first fluid reduces the velocity; wherein the reduction of velocity of the first fluid turns into an increase in pressure; the cell assembly also comprises a return vane, which is a cavity shaped to guide the first fluid after it left the diffuser, whose flow area increases in the direction of flow; the cell assembly being designed to be installed as a single cell or as multiple cells in tandem on the same hollow shafts;

stators, which are static blade elements foil shaped, used to redirect the second fluid flow when the fluid enters the chamber between the inner and the outer hollow shafts; wherein the second fluid reduces its turbulence when passes around the stators before it gets in contact with the internal array of blades;

a pump hub, which is the hub at the end of the outer hollow shaft, on the back of the hyperbolic geometrically shaped expansion chamber, in the first fluid suction cavity; wherein the pump hub has a hydrodynamic shape; wherein the first fluid is directed toward the external array of blades when it contacts the pump hub;

a first fluid discharge chamber, which is a cavity where the first fluid is discharged after it left the cell assembly; wherein the first fluid is directed to the first fluid discharge.

2. The artifact described in claim 1 having a spiral scroll case around the cylindrical housing, installed closer to the location of the first fluid suction; the spiral scroll case having a second fluid inlet nozzle, to introduce the second fluid into the artifact; the spiral scroll case further having hollow stators, which are static hollow elements foil shaped externally and internally, to allow the pass of the first fluid externally around each element, and to allow the pass of the second fluid internally through each element; wherein the hollow stators extend from the spiral scroll case, going through the pump hub, until the expansion chamber; wherein the second fluid is introduced into the expansion chamber; wherein the expansion chamber has no prong; wherein the artifact is further having a solid inner shaft; wherein the second fluid is directed to the second fluid discharge chamber between the solid inner shaft and the hollow outer shaft.

3. The artifact described in claim 1; further having the first fluid discharge, the second fluid inlet and the second fluid outlet, all in a concentric array of axial pipes; the housing further having the inner hollow shaft and the outer hollow shaft in a concentric array of axial pipes; wherein the inner hollow shaft is in direct and axial connection with the second fluid inlet; where in the outer hollow shaft is in direct and axial connection with the second fluid outlet.

4. The artifact described in claim 1; further having the first fluid discharge, the second fluid inlet and the second fluid outlet, all in a concentric array of axial pipes; the housing further having the inner hollow shaft and the outer hollow shaft in a concentric array of axial pipes; wherein the inner hollow shaft is in direct and axial connection with the second fluid inlet; the housing further having internal nozzles at the end of the outer hollow shaft; where in the second fluid is discharged into the first fluid discharge chamber throughout said internal nozzles; wherein the second fluid and the first fluid are discharged together from the artifact.

5. The artifact described in claim 1 having; the inner hollow shaft further having discharge nozzles around the walls; wherein the second fluid passes through said discharge nozzles and is directed to the second fluid discharge chamber.

6. The artifact described in claim 1, further connected to a manifold throughout concentric conductors or pipelines; the manifold having separated compartments; wherein each compartment is connected to one manifold nozzle, wherein said manifold nozzles are used to introduce the second fluid, or discharge the second fluid, or discharge the first fluid.

7. A fluids transportation system connected in a circuit as a whole, comprising the artifact described in claim 1, installed on the subsea, or installed onshore, or installed underground; the fluid transportation system further having a first fluid conductor or transportation pipeline, to transport the first fluid to its destination; the fluid transportation system further having a second fluid conductor or transportation pipeline, wherein the second fluid conductor transports the second fluid to the said artifact; the fluid transportation system further having a second fluid conductor or transportation pipeline; wherein the second fluid conductor transports the second fluid from the said artifact to the second fluid destination; the fluids transportation system further having an externally powered surface pumping system to impulse the second fluid through the second fluid conductor connected to the said artifact, all connected in circuit.

8. A fluids transportation system connected in a circuit as a whole, comprising a single or multiple of the artifact described in claim 1 installed on the subsea, or installed onshore, or installed underground; the fluid transportation system further having a first fluid conductor or transportation pipeline, to transport the first fluid to its destination; the fluid transportation system further having a second fluid conductor or transportation pipeline inside and concentric to the first fluid conductor, wherein the second fluid conductor transports the second fluid to the said artifact; the fluid transportation system further having a second fluid conductor or transportation pipeline inside and concentric to the conductor that transport the second fluid to the said artifact; wherein the second fluid conductor transports the second fluid from the said artifact to the second fluid destination; the fluids transportation system further having an externally powered surface pumping system to impulse the second fluid through the second fluid conductor connected to the said artifact, all connected in circuit.

9. The fluids transportation system described in claim 8 further having a first fluid conductor or transportation pipeline to transport the first fluid together with the second fluid to their destination.

10. The process to boost or increase pressure in a pipe, pipeline or vessel system containing the first fluid or a mix of the first and second fluids, with the artifact described in claim 1, using a motive fluid thrust by an external powered equipment placed away from the location of the artifact.

* * * * *